US008726768B2

(12) United States Patent
Mitchell

(10) Patent No.: US 8,726,768 B2
(45) Date of Patent: May 20, 2014

(54) ADJUSTABLE WRENCH

(76) Inventor: Scott Horton Mitchell, Toronto (CA)

( * ) Notice: Subject to any disclaimer, the term of this patent is extended or adjusted under 35 U.S.C. 154(b) by 509 days.

(21) Appl. No.: 13/017,278

(22) Filed: Jan. 31, 2011

(65) Prior Publication Data

US 2012/0192684 A1 Aug. 2, 2012

(51) Int. Cl.
*B25B 13/14* (2006.01)
*B25B 13/18* (2006.01)
*B25B 13/36* (2006.01)

(52) U.S. Cl.
USPC ..... 81/165; 81/129.5; 81/136; 81/138; 81/141; 81/143

(58) Field of Classification Search
USPC ..... 81/129, 129.5, 134, 136, 138, 139, 140, 81/141, 142, 143, 145, 146, 148, 149, 81/126–128
See application file for complete search history.

(56) References Cited

U.S. PATENT DOCUMENTS

| | | | | |
|---|---|---|---|---|
| 1,162,136 | A | 11/1915 | Chapman | |
| 1,689,072 | A * | 10/1928 | Grimsrud | 81/129.5 |
| 1,792,338 | A | 2/1931 | Walz | |
| 2,015,895 | A | 10/1935 | Hagbo | |
| 2,582,591 | A | 1/1952 | Hicks et al. | |
| 2,669,146 | A | 2/1954 | Florence | |
| 2,988,941 | A * | 6/1961 | Ortman | 81/344 |
| 3,232,150 | A * | 2/1966 | Ailegraud | 81/143 |
| 3,354,755 | A | 11/1967 | Legrande | |
| 3,817,128 | A | 6/1974 | Evans | |
| 4,214,491 | A | 7/1980 | Martinmaas | |
| 4,735,121 | A | 4/1988 | Coulson | |
| 5,152,198 | A | 10/1992 | Schmitz, Jr. | |
| 6,145,415 | A * | 11/2000 | Liu | 81/143 |
| 7,096,767 | B2 | 8/2006 | Sherburne | |
| 7,748,299 | B2 * | 7/2010 | Wu | 81/145 |
| 8,056,451 | B2 * | 11/2011 | Chervenak et al. | 81/367 |
| 2005/0109168 | A1 | 5/2005 | Clauson | |
| 2006/0266164 | A1 | 11/2006 | Gao | |
| 2008/0060484 | A1 | 3/2008 | Juieng | |
| 2009/0301268 | A1 | 12/2009 | Wu | |

* cited by examiner

*Primary Examiner* — Hadi Shakeri
(74) *Attorney, Agent, or Firm* — Sand & Sebolt

(57) ABSTRACT

An adjustable wrench is provided which provides several advantageous aspects. One aspect of the wrench is to facilitate rapid adjustment of the jaws, which are typically spring biased toward one another. Another aspect is the ability to adjust the jaws according to Metric system measurements or English system measurements or the like. A further aspect is the quick and effective tightening of the jaws.

19 Claims, 13 Drawing Sheets

ADJUSTABLE WRENCH

BACKGROUND OF THE INVENTION

1. Technical Field

The present invention is related generally to hand tools. More particularly, the present invention is related to adjustable wrenches. Specifically, the present invention is related to an adjustable wrench which is configured to facilitate rapid adjustment and effective tightening of the jaws.

2. Background Information

A large variety of adjustable wrenches have been proposed during the last century or so. A large number of these include a handle with a fixed jaw and an adjustable jaw which moves toward or away from the fixed jaw to adjust the size of the gap therebetween for receiving therein a nut, bolt head or the like. Some of these adjustable wrenches have also incorporated an additional pivoting handle which may or may not result in a pliers-like concept. Adjustable wrenches, often referred to as crescent wrenches, very often utilize a worm gear for the purpose of adjusting the jaws. Other adjustable wrenches have eliminated this worm gear, replacing it with a locking plate or the like having teeth thereon which are configured to engage or disengage from teeth on the adjustable jaw in order to respectively secure the adjustable jaw in a given position or allow it to be adjusted. Some of these types of wrenches have springs which bias the jaws either apart from one another or toward one another. Although these many types of adjustable wrenches have addressed various problems in the art, there is still room for improvement, which the present adjustable wrench offers.

BRIEF SUMMARY OF THE INVENTION

The present invention provides an adjustable wrench comprising an elongated handle having front and rear ends; first and second jaws mounted on the handle adjacent the front end; wherein the first jaw is movable toward and away from the second jaw; a spring which biases the first jaw toward the second jaw; a jaw locking member which is movable between a locked position and an unlocked position; wherein the locking member in the locked position secures the first jaw in a selected one of a plurality of secured positions to prevent movement of the first jaw away from the second jaw; and the locking member in the unlocked position allows the movement of the first jaw toward the second jaw in response to the bias of the spring; and a jaw-opening actuator having first and second actuator positions; wherein in response to movement of the actuator from the first actuator position to the second actuator position, the locking member moves from the locked position to the unlocked position and the first jaw moves away from the second jaw.

The present invention also provides an adjustable wrench comprising an elongated handle having front and rear ends; first and second jaws mounted on the handle adjacent the front end; wherein the first jaw is movable toward and away from the second jaw; an actuator pivot adjacent the front end of the handle; a jaw opening actuator pivotally mounted about the actuator pivot and extending rearwardly therefrom; a drive arm pivot which is rearward of the actuator pivot; a drive arm comprising a rear leg extending rearwardly from adjacent the drive arm pivot and a front leg extending forward from adjacent the drive arm pivot; a first engagement between the actuator and the rear leg of the drive arm during pivotal movement of the actuator; and a second engagement between the front leg of the drive arm and the first jaw during pivotal movement of the drive arm; wherein the first jaw moves away from the second jaw in response to pivotal movement of the actuator.

The present invention further provides an adjustable wrench comprising an elongated handle having front and rear ends; first and second jaws mounted on the handle adjacent the front end; wherein the first jaw is movable toward and away from the second jaw; a jaw locking member which is movable between a locked position and an unlocked position; wherein the locking member in the locked position secures the first jaw in a selected one of a plurality of secured positions to prevent movement of the first jaw away from the second jaw; and the locking member in the unlocked position allows the movement of the first jaw toward the second jaw; and a tightening mechanism capable of moving the first jaw toward the second jaw when the locking member is in the locked position.

BRIEF DESCRIPTION OF THE SEVERAL VIEWS OF THE DRAWINGS

A preferred embodiment of the invention, illustrated of the best mode in which Applicant contemplates applying the principles, is set forth in the following description and is shown in the drawings and is particularly and distinctly pointed out and set forth in the appended claims.

Similar numbers refer to similar parts throughout the drawings.

DETAILED DESCRIPTION OF THE INVENTION

Figure 1:
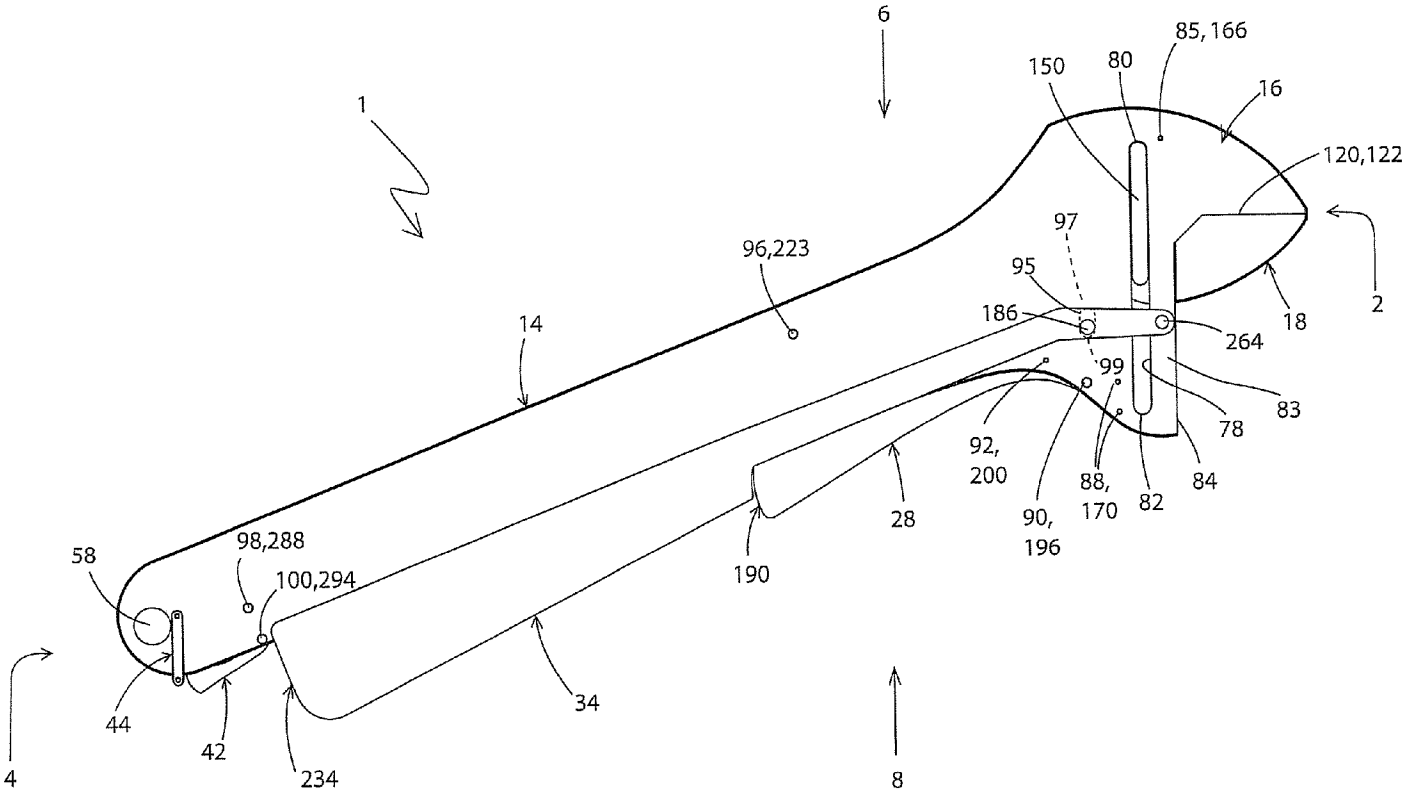
FIG. 1 is a right side elevational view of a first embodiment of the adjustable wrench of the present invention.
Figure 9:
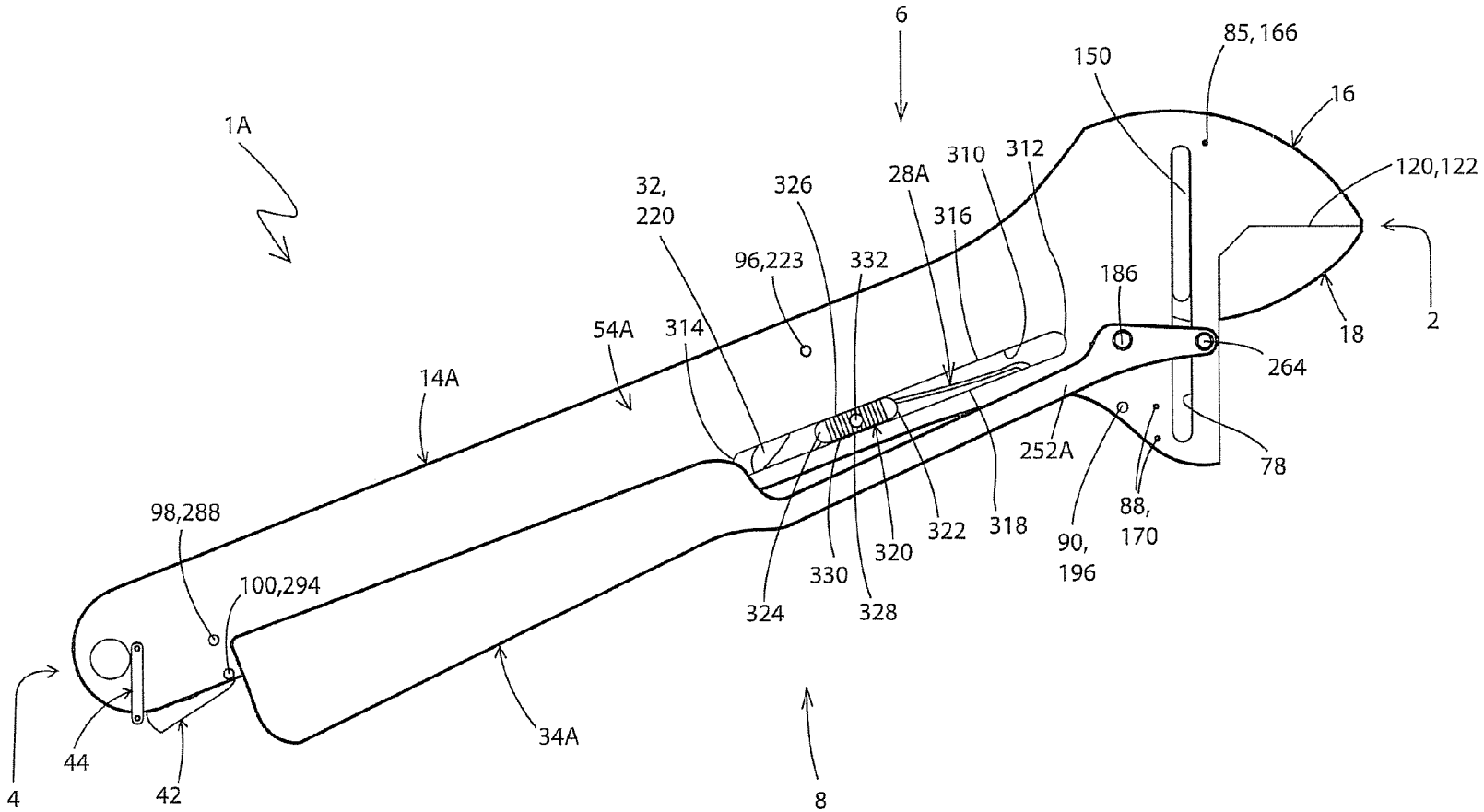
FIG. 9 is a right side elevational view of a second embodiment of the adjustable wrench of the present invention showing the jaws in the fully closed position with a manual slider on the handle which is used for opening the jaws.

A first embodiment of the adjustable wrench of the present invention is shown generally at 1 in FIG. 1; and a second embodiment is shown generally at 1A in FIG. 9. Wrench 1 has a front or front end 2 and a back or rear end 4 defining therebetween a longitudinal direction of the wrench, a top 6, a bottom 8, and a left side 10 (FIG. 2) and a right side 12 defining therebetween an axial direction of the wrench.

Figure 3:
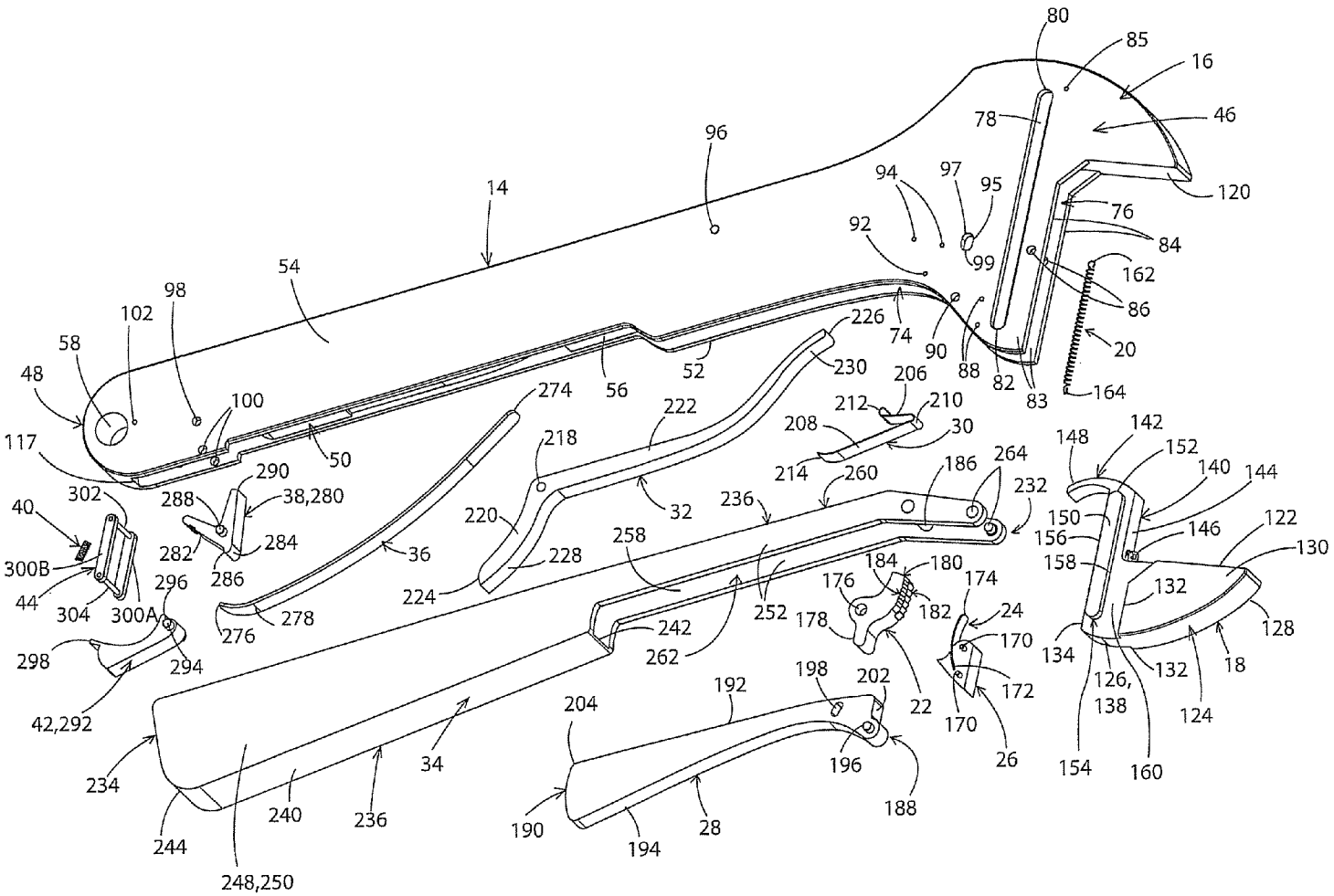
FIG. 3 is an exploded perspective view of the first embodiment.
Figure 4:
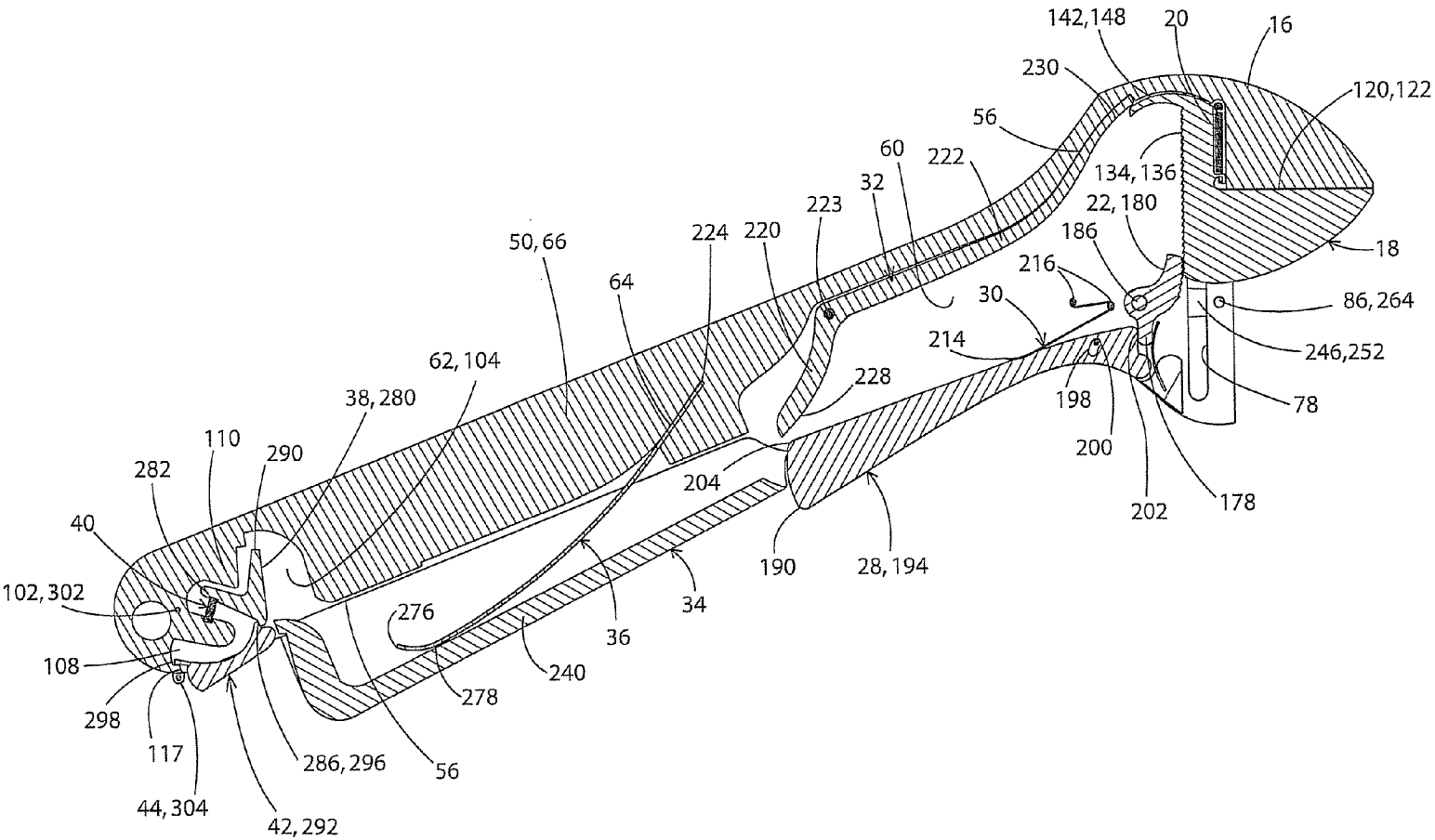
FIG. 4 is a sectional view taken on line 4-4 of FIG. 2 showing the adjustable wrench with the jaws in a fully closed position.
Figure 5:
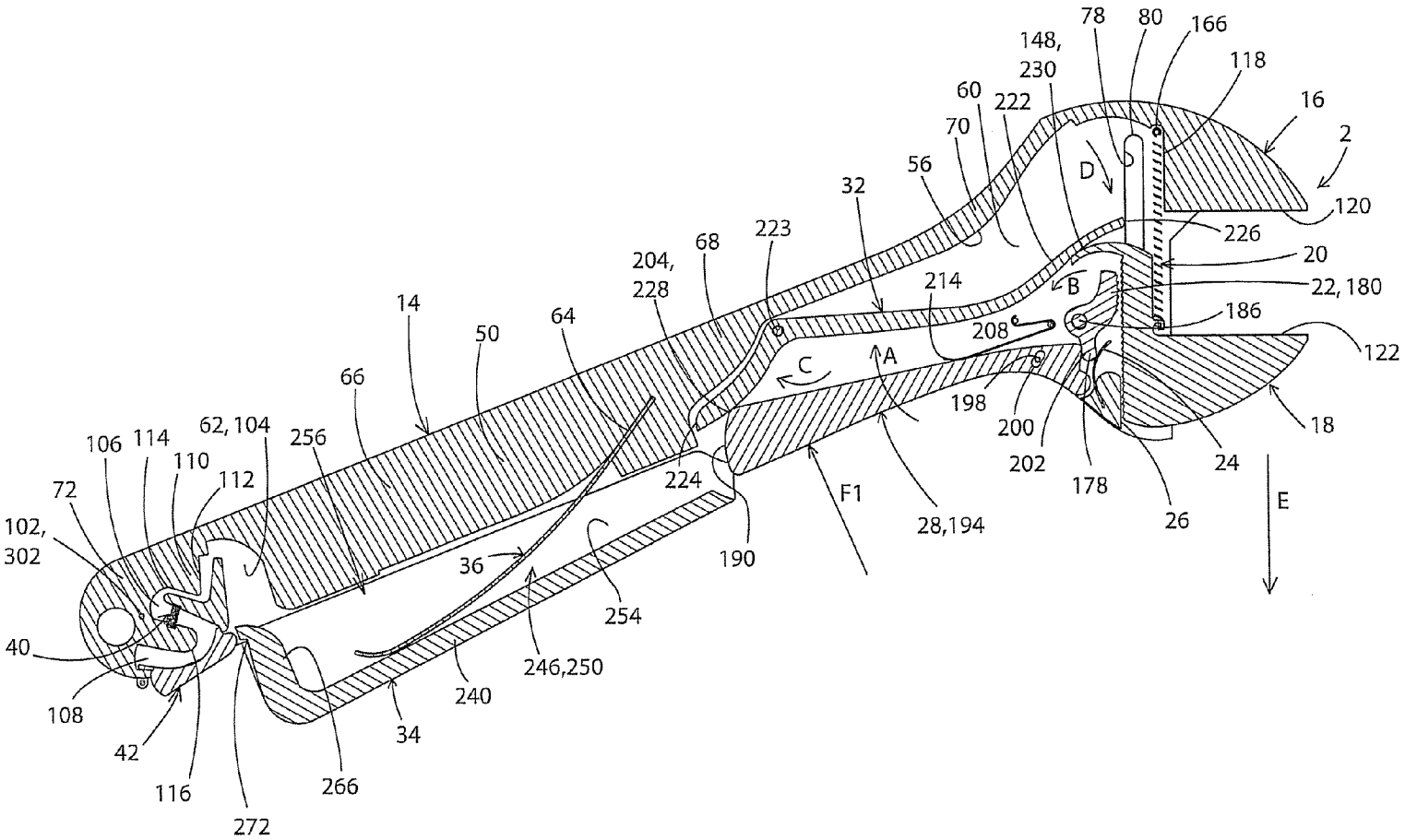
FIG. 5 is a sectional view similar to FIG. 4 showing the jaws in an open position.

Referring now primarily to FIGS. 3-5, wrench 1 includes a rigid longitudinally elongated handle 14 and a rigid fixed first jaw 16 which is rigidly and fixedly secured to the front end of handle 14 typically such that handle 14 and jaw 16 together form a single rigid structure which is the primary structural component of wrench 1. Handle 14 and jaw 16 are typically formed of metal. Wrench 1 further includes a rigid adjustable second jaw 18 movably mounted adjacent the front of handle 14 such that jaw 18 is movable toward and away from jaw 16. A jaw spring 20 in the form of a coil spring is provided to bias or urge jaw 18 toward jaw 16. Wrench 1 further includes a pawl or jaw locking member 22, a pawl spring 24, a pawl spring mount 26, a longitudinally elongated first lever 28, a first lever spring 30, a link or drive arm 32, a longitudinally elongated second lever 34 which is substantially longer than the first lever 28, a second lever spring 36, a second lever locking member 38, a locking member spring 40, a release member 42 and a retaining member 44. Except for springs 24, 30, 36 and 40, each of these additional components is a substantially rigid member or component which is typically formed of metal or other suitable material.

With continued reference to FIGS. 3-5, handle 14 is described in greater detail. Handle 14 has a front 46 and a back 48 between which it is generally straight and elongated, with a head adjacent front end 46 which is vertically wider than the remainder of the handle. Handle 14 includes a rigid central wall 50, a left wall 52 rigidly secured to the left side of central wall 50, and a right wall 54 rigidly secured to the right side of central wall 50. Walls 50, 52 and 54 are formed of respective substantially flat plates which are parallel to one another and vertically oriented in the position shown in FIG. 1. A hanging hole 58 may be formed through handle 14 adjacent rear end 48 for hanging the wrench on a nail or the like. Central wall 50 includes a relatively complex contoured lower surface which faces generally downwardly and defines a forward or front cavity 60, a rearward or rear cavity 62, and a narrow spring mount cavity or slot 64 which is rearward of front cavity 60 and forward of rear cavity 62. Central wall 50 thus includes a wider segment 66 which is generally rectangular as viewed from the side, a tapering segment 68 which is generally triangular and extends forward from segment 66, a narrower segment 70 which extends forward from tapering segment 68, and a rear segment 72 which extends rearwardly from the back of wider segment 66 generally rearward of and above rear cavity 62.

Front cavity 60 is defined between the inner surfaces of left and right walls 52 and 54 and extends downwardly from the contoured lower surface 56 of narrower segment 70 and tapered segment 68 to a bottom entrance opening 74 which extends forward generally from the front of wider segment 66 or from tapered segment 68 to the rear of mount 26. Front cavity 60 also extends forward to the front of walls 52 and 54, which extend downwardly from jaw 16, to a front entrance opening 76 extending upwardly generally from the top of mount 26 to the bottom of jaw 16. A substantially straight elongated vertical keyway or slot 78 is formed in each of walls 52 and 54 so that slots 78 are aligned with one another as viewed from the side. Each slot has a top end 80 and a bottom end 82. Each of walls 52 and 54 has a substantially straight and vertical front edge 84 which is parallel to, forward of and adjacent slot 78. Walls 52 and 54 each have a vertically elongated straight arm 83 defined between the front vertical edge of slot 78 and front edge 84.

A variety of holes are formed through walls 52 and 54 such that each hole formed in wall 52 has a corresponding hole formed in wall 54 which is aligned therewith as viewed from the side to form a set of holes which receive pins or pivots as discussed further below. Amongst these holes is a pin mounting hole 85 (or set thereof) which is formed below and adjacent the front of narrower segment 70 of handle 14 and rearward of and adjacent the top of jaw 16, and thus adjacent the intersection between the front of segment 70 and top rear of jaw 16. A corresponding set of second lever pivot holes 86 is formed in arms 83 of walls 52 and 54 between front edges 84 and slots 78 spaced downwardly from jaw 16 and upwardly from bottom end 82 of slot 78. Two sets of mounting holes 88 are provided adjacent and rearward of the lower ends 82 of slots 78. First lever pivot holes 90 are provided rearward and adjacent of mounting holes 88 with a set of pin mounting holes 92 rearward and adjacent pivot hole 90. In addition, two sets of pin mounting holes 94 are positioned adjacent and above mount holes 92. A pawl pivot hole or elongated slot 95 is formed through walls 52 and 54 rearward of and adjacent slots 78 at roughly the same height as pivot holes 86. Although slot 95 is far shorter than elongated slot 78, it is vertically elongated between a top end 97 and a bottom end 99. A link or drive arm pivot hole 96 is formed in each of walls 52 and 54 and is spaced rearward of the aforementioned holes and slots about a third of the length of handle 14 rearward from its front end. Holes 96 are adjacent the intersection of tapered segment 68 and narrower segment 70, and thus adjacent the front of tapered segment 68 and the rear of the narrower segment 70 spaced a short distance downwardly from contoured surface 56. Each of the aforementioned holes in the present paragraph communicates with front cavity 60. Adjacent the rear end 48 of handle 14, additional holes are formed which communicate with rear cavity 62, including locking member pivot holes 98 and release member pivot holes 100 which are adjacent and below holes 98. Retaining member mounting holes 102, which are rearward of holes 98 and 100 just forward of hanging hole 58, do not communicate with rear cavity 62 and extend through central wall 50.

As shown in FIGS. 4 and 5, rear cavity 62 includes a front portion 104, a middle portion 106 and a rear portion 108. Central wall 50 includes a projection 110 which extends downwardly adjacent the rear end of the handle between front and middle portions 104 and 106. Projection 106 has a front stop surface 112 which faces generally forward and bounds front portion 104, and a rear stop surface 114 which faces generally rearwardly and downwardly and bounds middle portion 106. Central wall 50 further includes an additional cantilevered leg or projection 116 which extends downwardly and forward from adjacent the rear portion of the handle into rear cavity 62 whereby projection 116 separates middle and rear portions 106 and 108 from one another. Wall 50 also includes another cantilevered leg or projection 117 extending forward from the bottom rear end of handle 14 below and bounding rear portion 108 of cavity 62.

Fixed jaw 16 is rigidly secured between left and right walls 52 and 54 adjacent the front end 2 of the wrench. Jaw 16 is further rigidly secured adjacent its rear and top to the front of narrower segment 70 and extends downwardly and forward therefrom. Jaw 16 includes a substantially vertical rearwardly facing rear surface 118 which faces and bounds front cavity 60 and extends downwardly from the front end of contoured lower surface 56 at the front of narrower segment 70 to meet a horizontal gripping surface 120 of jaw 16 at a right angle.

Gripping surface 120 extends forward from the bottom of rear surface 118 to front end 2 of wrench 1.

Figure 6:
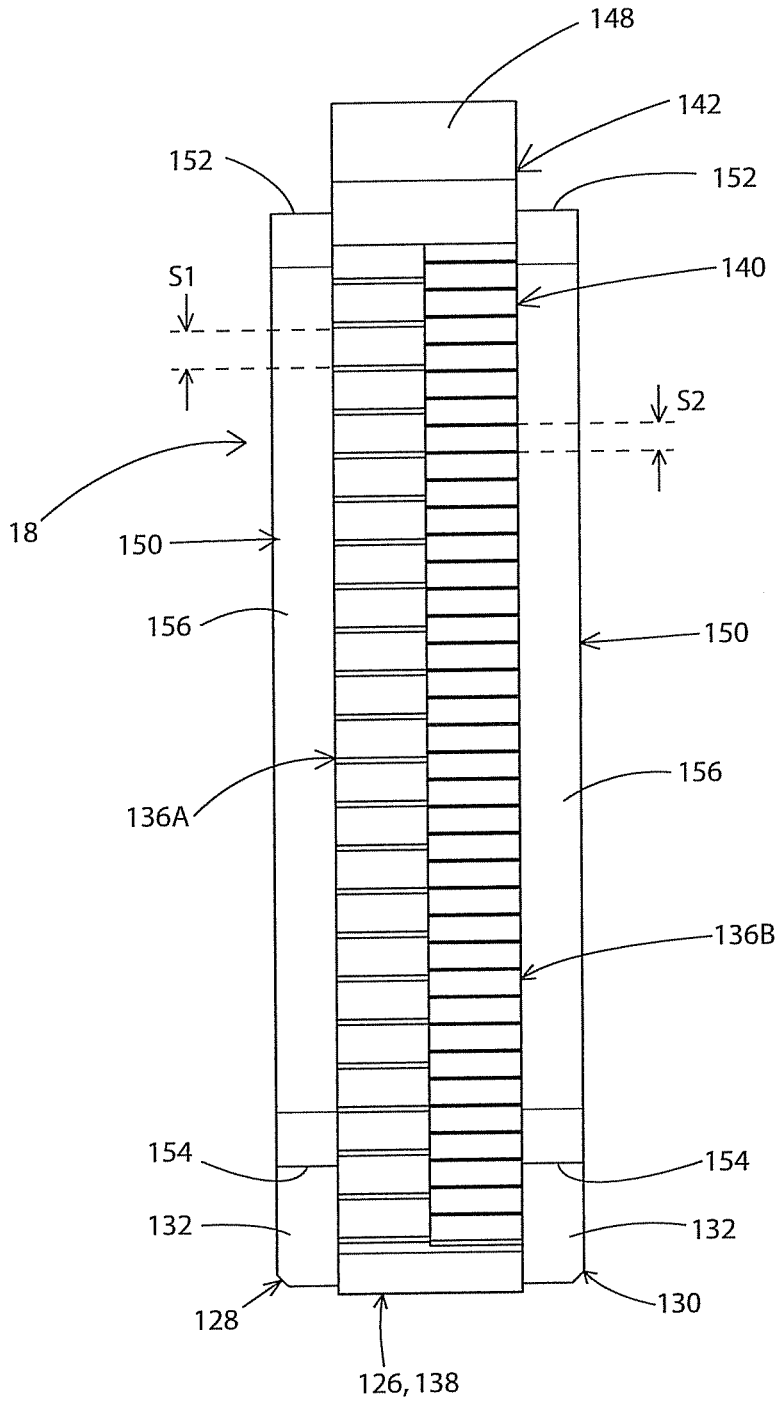
FIG. 6 is a rear elevational view of the adjustable jaw showing two different sets of teeth.

Adjustable jaw 18 has a flat straight gripping surface 122 which faces upwardly and thus toward the downwardly facing gripping surface 120 of jaw 16 whereby gripping surfaces 120 and 122 abut one another in the closed position of jaw 18 shown in FIG. 1. Jaw 18 has, as measured from side to side, a wider portion 124 and a narrower portion 126 which extends rearwardly from portion 124. Wider portion 124 defines the front of jaw 18 and extends rearwardly therefrom. Wider portion 124 includes a left wall portion 128 and a right wall portion 130 which respectively extend outwardly to the left and right from the left and right surfaces of narrower portion 126 at respective ledges or steps 132 which are vertical and serve as the rear end of the respective wall portion 128 and 130. Ledges 132 are typically vertical and parallel to front edges 84 of left and right walls 52 and 54. Narrower portion 126 extends rearwardly from ledges 132 to a substantially vertical rearwardly facing surface 134 which extends from the left side to the right side of portion 126. Surface 134 defines left and right vertically elongated racks 136A and 136B each of which includes multiple one way locking teeth which are vertically spaced one from another, as shown in FIG. 6. Although the teeth and the left rack 136A are equally spaced one from another vertically and the teeth and the right rack 136B are equally spaced one from another vertically, the spacing S1 between the teeth in the left rack and the spacing S2 between the teeth in the right rack is different. More particularly, the spacing between the teeth and one of the racks is configured to represent spacing measured with the metric system whereas the spacing in the other rack is measured with the English system or the SAE system. Racks 136 are an integral part of jaw 18 and are fixed relative to one another.

Narrower portion 126 includes a lower portion 138 which extends rearwardly directly behind wider portion 124, and an upper portion or leg 140 which extends upwardly from lower portion 148 in a cantilever fashion above the top of wider portion 124. Narrower portion 126 further includes a cam follower or arm 142 which is secured to and extends rearwardly from the top of leg 140 in a cantilever fashion to a rearward terminal end. Leg 140 has a substantially vertical front surface 144 which faces forward with its lower end intersecting the back end of gripping surface 122 at right angles. A spring mount 146 such as a pin or other suitable structure is secured to and extends forward outwardly from front surface 144 adjacent the intersection between surfaces 122 and 144. Arm 142 has a cam surface 148 which is adjacent the rearward free end thereof and faces generally upwardly. Left and right vertically elongated keys 150 are rigidly secured to and extend outwardly respectively from the left and right sides of narrower portion 126 and extend along the lower and upper portions 138 and 140 thereof. Each key 150 has a top end 152, a bottom end 154, a straight vertical back edge 156 and a straight vertical front edge 158 parallel thereto. The front edge 158 of each key 150 and the corresponding back edge or ledge 132 define therebetween a straight vertical channel 160.

Adjustable jaw 18 is slidably mounted on handle 14 adjacent its front end so that jaw 18 is able to move forward and away from jaw 16. More particularly, narrower section 126 is received between the left and right walls 52 and 54 with keys 150 within the respective slots or keyways 78 and vertical straight arms 83 respectively within channels 160. The horizontal width defined between back and front edges 156 and 158 of each key 150 is only slightly less than that defined between the front and rear vertical edges of keyway 78. Similarly, the front and back edges of each arm 83 define therebetween a horizontal width which is only slightly less than that of channel 160 defined between front edge 158 and back edge 132. Thus, jaw 18 is configured to slide smoothly in a linear fashion during the closing and opening thereof with a sliding engagement between jaw 16 and each of left and right walls 52 and 54. Top and bottom ends 152 and 154 of each key 150 define therebetween a length which is substantially shorter than that defined between top and bottom 80 and 82 of each keyway 78. Top 80 may serve as a stop which top end 152 engages in order to limit the upward movement of jaw 18, while bottom 82 may likewise serve as a stop which bottom end 154 of key 150 abuts to limit the downward movement of jaw 18. Arm 142 extends rearwardly beyond keyways 78 into front cavity 60.

Spring 20 has a first or top end 162 and a second or bottom end 164. Top end 162 is secured to a spring mount in the form of spring mounting pin 166 which is secured within holes 85 and extends between left and right walls 52 and 54. Bottom end 164 is secured to spring mount 146 of jaw 18. As previously noted, spring 20 biases jaw 18 in the closing direction or toward jaw 16 and will, absent a stronger force to the contrary, cause jaw 18 to move to the fully closed position.

Locking member 22, spring 24 and spring mount 26 are now described in greater detail. The rigid body of spring mount 26 defines a narrow spring mounting slot 168 which has an entrance opening along the outer surface of mount 26 for receiving therein spring 24. Mounting pins 170 or other fasteners extend outwardly from spring mount 26 and are respectively received within mounting holes 88 to help rigidly secure spring mount 26 between left and right walls 52 and 54 so that spring mount 26 is fixed relative to said walls rearwardly of and adjacent the lower end 82 of each slot or keyway 78. Spring 24 is a leaf spring with lower end 172 inserted into slot 168 to secure spring 24 to spring mount 26. Spring 24 is formed of a plate of spring metal which is curved from end to end such that the body of the spring extends outwardly from slot 168 in a cantilever fashion to a second free upper end 174.

Locking member 22 is entirely within front cavity 60 and is adjacent the front of cavity 60 within the lower half of cavity 60. Locking member 22 defines a pivot hole 176 and includes a cam follower or arm 178 which extend radially outwardly away from hole 176, and a locking or pawl arm 180 which extends radially outwardly away from hole 176 upwardly in a direction generally opposite that of arm 178. Arm 180 has a front surface which defines a left row of one-way engaging or locking teeth 182 and a right row of one-way engaging or locking teeth 184. The vertical spacing between the teeth in left row 182 is different than the vertical spacing between the teeth in right row 184. The spacing of the teeth in left row 182 corresponds to the spacing of the teeth in left rack 136A, while the spacing between the teeth in right row 184 corresponds to the spacing of the teeth in right rack 136B. Left and right rows 182 and 184 are an integral part of locking member 22 and are fixed relative to one another. Pivot hole 176 receives a pivot 186 which defines a horizontal axis extending from left to right about which locking member 22 pivots. Pivot 186 and the horizontal pivot axis are adjacent and rearward of jaw 18 adjacent the front of handle 14 adjacent the front of cavity 60 and in the lower half of cavity 60. Spring 24 engages arm 178 generally along a forward lower surface thereof such that spring 24 biases arm 178 rearwardly and arm 180 forward to engage the left row of teeth 182 with the left rack of teeth 136A and the right row of teeth 184 with the right rack of teeth 136B. The engagement of the teeth of locking member 22 and jaw 18 locks jaw 18 into a chosen one of a variety of secured positions to prevent the opening or downward movement of jaw 18 away from jaw 16. Spring 24 thus biases locking member 22 to the engaged or locked position with its teeth engaging the teeth of jaw 18.

First lever 28 serves as a jaw opening actuator and is part of a drive train which drives movement of the adjustable jaw 18 away from fixed jaw 16. Lever 28 also serves as an unlocking actuator for driving movement of jaw locking member 22 from its locked to its unlocked position. First lever 28 has a first front or forward end 188 and a second rear or back end 190 between which lever 28 is elongated. Lever 28 has top and bottom surfaces which respectively face upwardly and downwardly and extend from adjacent front end 188 to adjacent back end 190. Lever 28 is pivotably mounted on handle 14 adjacent its front end via a pivot 196 which is received within holes 90 adjacent and rearward of the lower front end of handle 14 and lower end 82 of keyway 78. Lever 28 thus pivots about a horizontal axis which extends from left to right through the lower front portion of front cavity 60 and is parallel to the axis about which locking member 22 pivots. Pivot 196 is adjacent and lower than pivot 186, and in the exemplary embodiment substantially directly below pivot 186. A portion of lever 28 is within front cavity 60 and is movable upwardly and downwardly into and out of cavity 60 via its lower entrance opening 74. Lever 28 further defines a short but elongated slot 198 extending from its left side to its right side which receives therein a pin 200 which is mounted within holes 92 and extends from left wall 52 to right wall 54. Pin 200 helps to mount lever 28 on the handle and also serves to limit the pivotal movement of lever 28 in either direction by respectively engaging the opposed ends of slot 198. Lever 28 further has a front cam 202 which faces forward and engages the rear surface of cam follower or arm 178 of locking member 22 whereby cam 202 serves as a pawl-engaging or locking member-engaging cam. Cam 202 is adjacent the lower front end of handle 14 within the lower front portion of front cavity 60. Lever 28 further includes a rear second cam 204 adjacent its back end 190. Cam 204 is a surface adjacent the rear end of top surface 192 and generally faces upward and/or rearwardly. Rear cam 204 is adjacent the lower rear end of front cavity 60.

Spring 30 is a V-shaped leaf spring formed from a sheet of spring metal and having a shorter leg 206 and a longer leg 208 which intersect at a tip 210. Short leg 206 has an end 212 spaced from tip 210 while longer leg 208 has a free end 214 which is spaced rearwardly and downwardly from tip 210. Spring 30 is secured within front cavity 60 to walls 52 and 54 by a pair of spring mounting pins 216 which respectively are mounted within holes 94 and extend between left and right walls 52 and 54. Thus, end 212 is secured by one of pins 216 while tip 210 is secured by the other pin 216 whereby shorter leg 206 is fixed relative to the handle while longer leg 208 is mounted in a cantilever fashion such that free end 214 may pivot upwardly and downwardly about tip 210 and the forward pin 216 about a horizontal axis parallel to the earlier mentioned axes. The bottom surface of longer leg 208 adjacent free end 214 slidably engages top surface 192 of lever 28 whereby spring 30 biases or urges the rear end 190 of lever 28 downwardly.

Link or drive arm 32, which is entirely within front cavity 60, serves as part of the above-noted drive train of links which includes lever 28 to drive opening movement of jaw 18 relative to jaw 16. Link 32 serves as a cam follower and a cam as well in this drive chain. Link 32 defines a pivot hole 218 extending from its left side to its right side, and includes a shorter rear leg 220 which extends radially outwardly from pivot hole 218 in a rearward and downwardly direction, and a longer front leg 222 which extends radially outwardly from pivot hole 218 in a forward and upwardly direction. Rear leg 220 has a lower rear end 224, while front leg 222 has an upper front end 226. Each of legs 220 and 222 are cantilevered from a pivot 223 which is received through pivot hole 218 and holes 96 of handle 14 to provide the pivotal connection between link 32 and handle 14. Pivot 223 is adjacent and below the rear end of narrower segment 70 and adjacent and forward of the front upper end of segment 68 adjacent the rear upper portion of front cavity 60. Pivot 223 is spaced upwardly from, forward of and generally adjacent rear cam 204 of lever 28. Rear leg 220 has a cam surface 228 adjacent rear end 224 wherein surface 228 is a generally downward facing and forward facing surface which serves as a cam follower. Front leg 222 has a cam surface 230 adjacent front end 226 wherein surface 230 is a generally downward facing and forward facing surface which serves as a cam for imparting motion to the cam follower surface 148 on arm 142 of adjustable jaw 18.

Second or tightening lever 34 has front and back ends 232 and 234 between which it is generally straight and elongated. Lever 34 includes a rear section 236 which extends forward from rear end 234, and a front section 238 which extends forward from the front of rear section 236 to front end 232. Rear section 234 includes a bottom wall 240 which is elongated between a front end 242 and rear end 244 thereof. Lever 34 includes left and right side walls 246 and 248 which are rigidly secured to and extend upwardly from the left and right sides of bottom wall 240. Thus, bottom wall 240 extends axially from left sidewall 246 to right sidewall 248. Each of side walls 246 and 248 includes a rear portion 250 which extends from the front end 242 to the rear end 244 of rear section 236 and which extend upwardly from bottom wall 240. Each of left and right side walls 246 and 248 also includes a front portion or arm 252 which extends forward from the front of rear portions 250 and front end 242 of the bottom wall 240 in a cantilever fashion to terminal free ends at front end 232 of lever 34. Bottom wall 240 and rear portions 250 of left and right side walls 246 and 248 define therebetween a rear cavity 254 which has a top entrance opening 256. The front portions or arms 252 also define therebetween a front cavity or space 258 which communicates with the front of rear cavity 254 and extends forward therefrom to the front terminal ends of arms 252. Front cavity 258 has a top entrance opening 260 and a bottom entrance opening 262. A pair of second lever pivots 264 are rigidly secured to and extend inwardly from left and right arms 252 adjacent their respective front free terminal ends. More particularly, each pivot 264 extends into space or cavity 258 a relatively short distance to a terminal inner end whereby pivots 264 are received respectively within pivot holes 86. Pivots 264 are relatively short so that they do not extend beyond the respective left and right surfaces of narrower section 126 of jaw 18. Pivots 264 define therebetween a space in which narrower section 126 is disposed. Inasmuch as arms 83 of handle 14 are received within the respective channels 160, pivots 264 are likewise received within the respective channels 160. Locking member pivot 186 is secured to and extends between arms 252 rearwardly of and adjacent pivots 264. Pivots 264 are adjacent, forward of and higher than pivot 196 of lever 28. As previously noted, pivot 186 serves as the pivot for locking member 22 and is received through pivot hole 176 of member 22 as well as through slots 95 in walls 52 and 54 of handle 14 whereby pivot 186 serves as a stop which may alternately engage the top end 97 or bottom end 99 of slot 95 in order to respectively limit the upward and downward travel of the rear end of lever 34.

Figure 2:
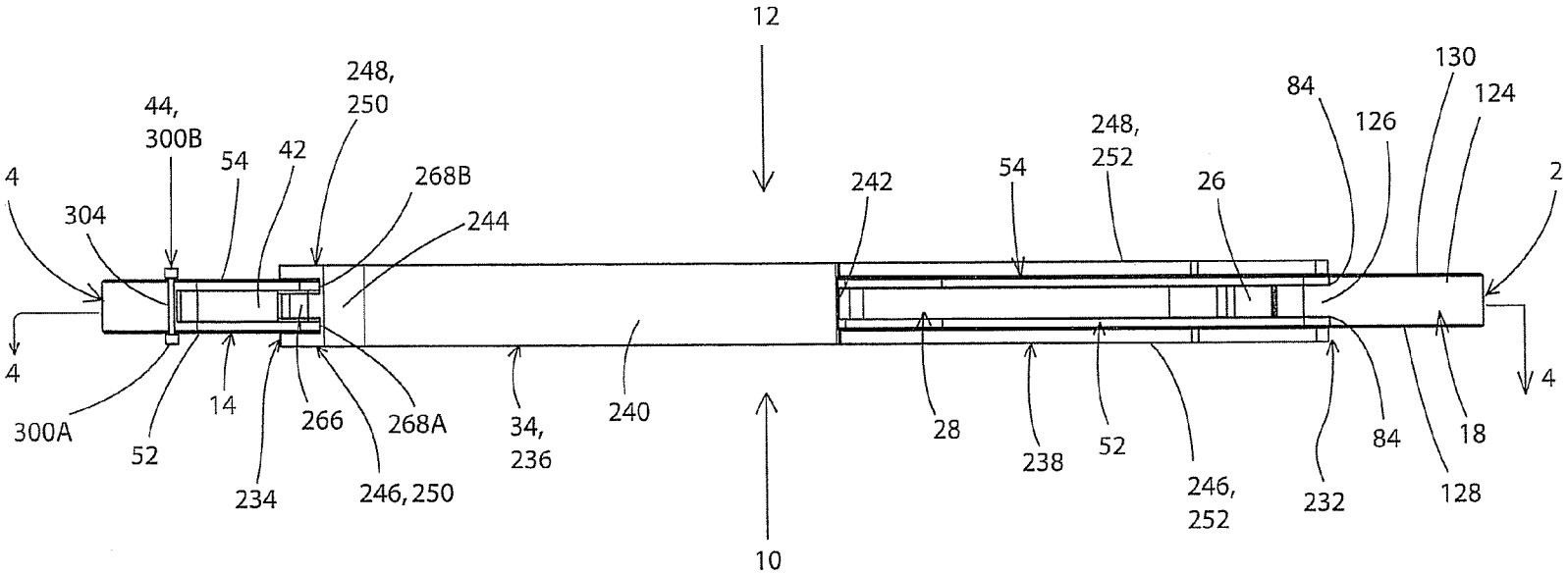
FIG. 2 is a bottom plan view of the first embodiment.
Figure 7:
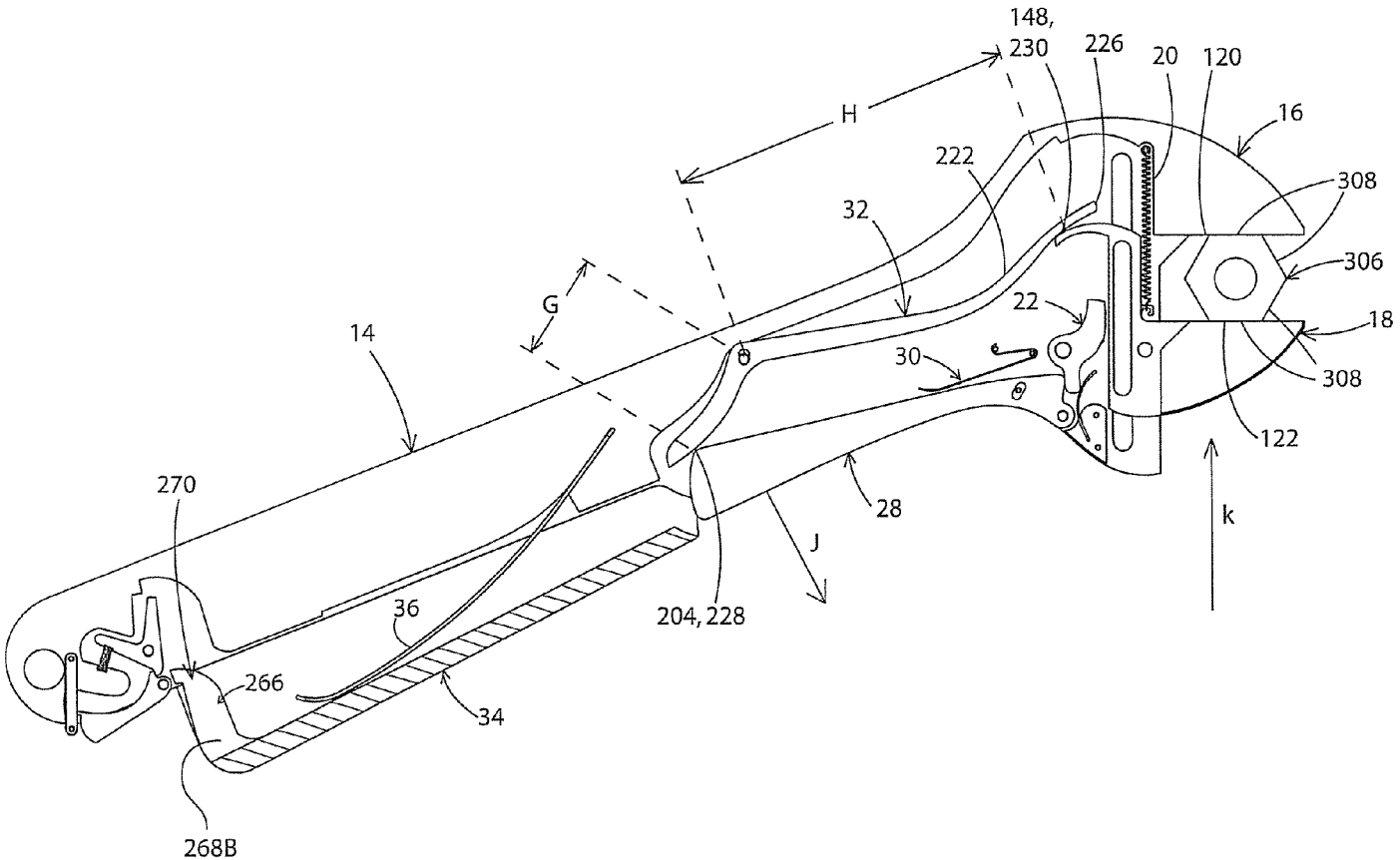
FIG. 7 is a right side elevational view of the first embodiment with the right wall of the handle removed and the tightening lever shown in section in its home resting position and the jaws shown in an open position closer to one another than shown in FIG. 5.

Rear section 236 of lever 34 further includes a rear wall or catch 266 (FIG. 5) which is rigidly secured to the back of bottom wall 240 and extends upwardly therefrom between rear portions 250 of left and right side walls 246 and 248. More particularly, catch 266 is cantilevered upwardly from bottom wall 240 and is spaced inwardly from left and right side walls 246 and 248 whereby the left side of catch 266 and the right or inner surface of left side wall 246 define therebetween a left notch 268A (FIG. 2). Likewise, the right side of catch 266 and the left or inner surface of right side wall 248 define therebetween a right notch 268B (FIGS. 2, 7). Each of notches 268 extends upwardly from the top of bottom wall 240 and has a top entrance opening 270 (FIG. 7). Catch 266 adjacent its upper end includes a downwardly facing and rearwardly extending catch ledge 272.

Figure 8:
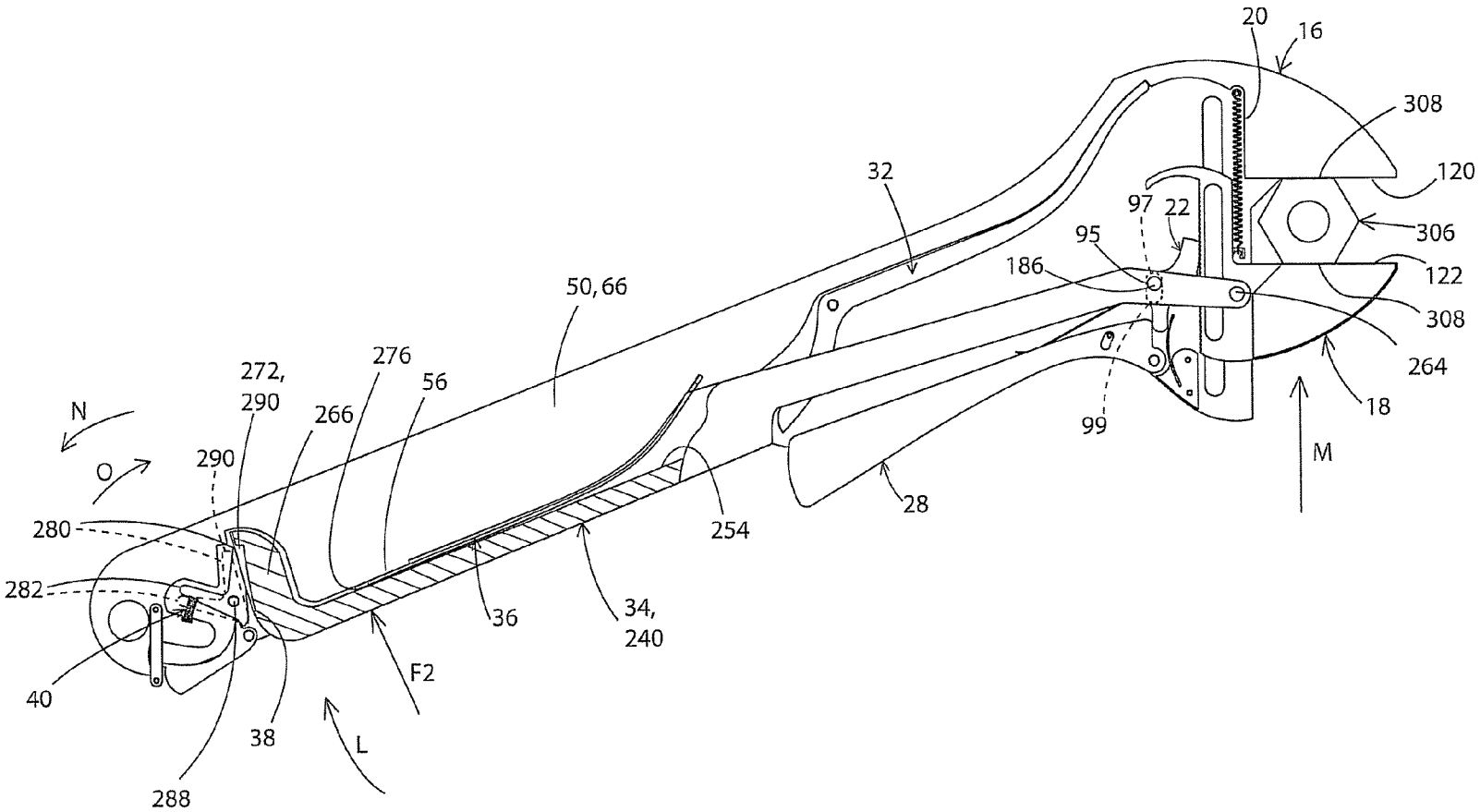
FIG. 8 is a side elevational view similar to FIG. 7 with the right wall of the handle removed, showing the tightening lever in its tightened and locked position so that the jaws are tightly clamped on a nut or bolt head.

When the rear end or rear section of lever 34 is pivoted upwardly about pivots 264 to partially or fully close (FIG. 8), wider segment 66 of central wall 50 and portions of left and right walls 52 and 54 abutting segment 66 are received within rear cavity 254 via top entrance opening 256 (FIG. 5). During this pivotal movement, catch 266 is likewise received within front portion 104 of rear cavity 62. In addition, the portions of left and right walls 52 and 54 which bound front portion 104 are received respectively within left and right notches 268A and 268B via the respective top entrance openings 270 thereof (FIGS. 2, 7).

When lever 34 is in any position (fully open, fully closed or intermediate positions), portions of left and right walls 52 and 54 are received within cavity or space 258 between arms 252. The lower portion of front cavity 60 is also received within cavity 258, as are portions of lever 28, spring 30, locking member 22, keyways 78 and arms 83. Lever 28 is movable within top and bottom entrance openings 260 and 262 and is positioned with rear end 190 spaced forward of and adjacent front end 242 to allow levers 28 and 34 to pivot relative to handle 14 and one another preferably without engagement between ends 190 and 242. Portions of adjustable jaw 18 may also be received between the forward ends of arms 52, in particular the narrower section 126 and keys 150, at least when jaw 18 is in its fully opened position and typically when jaw 18 is in other intermediate open positions.

Second lever spring 36 has a front first end 274 and a rear second end 276. First end 274 is inserted into cavity or slot 64 through a bottom rearward entrance opening and may be secured simply by a press fit into the slot or by additional means if necessary in order to secure first end 274 to central wall 50 of handle 14. Spring 36 is in the form of a leaf spring and extends rearwardly from its secure rigid mounting of the front end 274 in a cantilever fashion to the free terminal rear end 276. Adjacent end 276, spring 36 includes a downwardly facing engaging surface 278 which engages the top of bottom wall 240 of lever 34 whereby spring 36 biases or urges the rear end of lever 34 pivotally downwardly relative to handle 14 to its home resting fully open position shown in FIGS. 4 and 5.

Second lever locking member 38 is a generally V-shaped structure having a first or front arm 280 and a second or rear arm 282 which intersect one another to form a tip 284 adjacent the bottom of member 38. Member 38 includes a cam follower surface 286 which faces rearwardly adjacent tip 284. A pivot 288 extends outwardly to the left and right from the intersecting portion of arms 280 and 282 such that pivots 288 are respectively received within pivot holes 98 to pivotally mount member 38 on handle 14. Each of arms 280 and 282 extend radially outwardly and generally upwardly from pivot 288 to free terminal ends. The terminal free upper end of front arm 280 serves as a locking ledge 290 which releasably engages catch ledge 272 of second lever 34 to releasably lock lever 34 as discussed. Member 38 is pivotable about an axis passing through pivots 288 which is horizontal, side-to-side and parallel to the previously noted axes. The rear of front arm 280 may abut stop surface 112 when pivoted in one direction (rearward) whereas the rear leg 282 may abut the stop surface 114 when pivoted in the opposite direction (forward). The bottom end of coil spring 40 is mounted atop leg or projection 116 so that spring 40 extends upwardly to its upper opposed end which is mounted on leg 282 of locking member 38. Spring 40 thus biases rear arm 282 away from projection 116 and toward projection 114, front leg 290 forward and away from projection 114 to the locked or locking position of member 38.

Release member 42 has front and rear ends between which it is elongated. Member 42 has a bottom downwardly facing surface 292 which serves as a manual pushing surface for pivoting release member 42. Member 42 has pivots 294 adjacent its front end which are received within respective pivot holes 100 to pivotally mount release member 42 on handle 14. Also adjacent its front end and extending upwardly from adjacent pivots 294, member 42 has a generally forward facing cam or cam surface 296 which engages cam follower surface 286 of locking member 38. Adjacent its rear end, release member 42 has a rearwardly projecting catch 298 which is received within rear portion 108 of rear cavity 62 and which is movable between a position engaging the top of leg or projection 117 and a position spaced upwardly from and out of engagement with leg 117.

Retaining member 44 has left and right straight parallel arms 300A and 300B. Member 44 further includes a pair of straight parallel pins or bars, one of which serves as a pivot 302 and the other of which serves as a retaining bar 304. These bars 302 and 304 are perpendicular to arms 300. Pivot 302 is secured to and extends between the upper ends of arms 300A and 300B. Similarly, retaining bar 304 is secured to and extends between the lower ends of arms 300A and 300B. Pivot 302 is received within pivot hole 102 to pivotally mount member 44 on handle 14 adjacent the rear end of thereof. Arms 300A and 300B are respectively disposed to the left of left wall 52 and to the right of right wall 54 and typically slidably engage the respective left and right outer surfaces of said walls during pivotal movement of member 44. Retaining bar 304 extends from the left side to the right side of handle 14 adjacent its rear end 48, which forms a semicircular configuration which is concentric about pivot 302 such that retaining bar 304 may in the exemplary embodiment pivot from the top rear to the bottom rear of handle 14. Retaining bar 304 is closely adjacent and may be in contact with the rear and lower surface of handle 14 adjacent the rear end thereof whereby bar 304 may slidably engage rear and lower surfaces during pivotal movement.

The operation of wrench 1 is now described with primary reference to FIGS. 4-8A. The use of lever 28 to open the jaws will be first described with reference to FIGS. 4 and 5, which respectively show the jaws in the fully closed position and an open position, which may represent a fully open or a partially open position. The user applies a squeezing force to handle 14 and first lever 28 rearward of pivot 196 and is typically adjacent the rear end 190 whereby a portion of the hand such as a finger or thumb applies a downward force on the top of the rear portion of handle 14 and an upward force F1 on the lower manual pushing surface 194 of lever 28 to rotate or pivot (Arrow A) the rear of lever 28 upwardly about pivot 196, which in part also pivotally moves front cam 202 forward against cam follower 178 of locking member 22, whereby a sliding engagement between cam surface 202 and cam follower 178 moves cam follower 178 forward against the spring bias of spring 24, thus pivotally moving locking member 22 about pivot 186 such that arm 180 pivots rearwardly (Arrow B) to move teeth 182 and 184 out of engagement with the teeth of racks 136A and 136B of adjustable jaw 18. When the teeth of locking member 22 and jaw 18 are engaged, the engagement prevents movement of jaw 18 away from jaw 16. When these teeth are disengaged from one another, jaw 18 may be moved away from jaw 16 to spread the jaws apart from one another if a sufficient downward force is applied to jaw 18 to overcome the spring bias of spring 20.

While the teeth of locking member 22 are disengaged from racks 136, the pivotal movement (Arrow A) of lever 28 noted above also causes the driving cam surface 204 to slidably engage the follower cam surface 228 rearward of and lower than pivot 223 which causes pivotal movement of link 32 about pivot 223 whereby the rear lower end 224 of rear leg 220 pivots generally rearwardly (Arrow C) about the pivotal axis 223 and the front end 226 of forward leg 222 pivots (Arrow D) primarily downwardly and somewhat forward as well from a position closely adjacent of abutting surface 56 of narrower segment 70 to a position out of engagement therewith so that end 226 moves closer to keyways 78 and the front end of handle 14. This pivotal movement of forward leg 222 causes a sliding engagement between cam surfaces 148 and 230 in the forward portion of front cavity 60 adjacent and rearward of keyway 78 and racks 136 and causes forward leg 222 adjacent front end 226 to force jaw 18 downwardly (Arrow E) away from jaw 16 against the spring bias of spring 20 such that gripping surfaces 120 and 122 are separated from one another to define therebetween a gap for receiving a nut, bolt head or other work piece. It is noted that the distance G (FIG. 7) between pivot 223 and the engagement between cam surfaces 204 and 228 is substantially less than the distance H between pivot 223 and the engagement between cam surfaces 148 and 230, whereby the distance traveled by lever 28 adjacent its rear end translates to a substantially greater distance traveled by jaw 18 away from jaw 16. Distance G and distance H will vary somewhat during the pivotal movement of lever 28 and link 32 in moving jaw 18. However, regardless of the position of these pivoting members, distance H is typically at least twice the distance G and in the exemplary embodiment is at least two and a half or three times distance G or more.

Once the jaws have been spread open sufficiently, they can be placed around a work piece 306 shown in FIG. 7 as a nut or bolt head having a plurality of flats 308, an opposed pair of which gripping surfaces 120 and 122 engage in order to grip and rotate the work piece. It is noted that work piece 306 may be of another configuration, such as a cylindrical pipe, especially where surfaces 120 and 122 are configured with teeth to grip the pipe or other object. Once the jaws 16 and 18 are positioned around work piece 306 with gripping surfaces 120 and 122 facing and spaced from the work piece, the user merely releases (Arrow J in FIG. 7) the pressure or force on surface 194 of lever 28 to allow adjustable jaw 18 to move toward jaw 16 (Arrow K) under the force provided by spring 20. More particularly, the release of lever 28 reverses the various movements of lever 28, link 32, jaw 18 and locking member 22 which are illustrated at Arrows A-E in FIG. 5 with spring 30 forcing lever 28 in this reverse movement, and springs 24 and 20 doing likewise to locking member 22 and jaw 18 respectively. Spring 20 rapidly snaps jaw 18 in the closing direction in order to engage the nut or other work piece 306. More particularly, the release of lever 28 allows spring 20 to bias jaw 18 toward jaw 16 either while locking member 22 remains completely disengaged from jaw 18 or while the teeth of members 22 and 18 engage one another, but are configured for a ratcheting movement due to the one way configuration of the teeth whereby the engagement of the teeth allows the closing movement of jaw 18 toward jaw 16. After the full release of handle 28 and closing movement of jaw 18 to engage work piece 306, locking member 22 will have moved to the locking position so that at least one of the left row of teeth 182 and right row of teeth 184 will respectively engage the left and right racks 136A and 136B of teeth (FIG. 6) so that gripping surfaces 120 and 122 of jaws 16 and 18 are as close to one another and to the respective surfaces such as flats 308 of work piece 306 which the gripping surfaces engage while of course being spaced such that they are wider than the work piece between the jaws. The left or right sets of teeth thus provide the suitable spacing between gripping surfaces 120 and 122 depending on whether the nut or bolt head is a metric size or an English or SAE size. Even though the gripping surfaces 120 and 122 may engage work piece 306, there is typically at least some play between the jaws due to some looseness of the sliding fit of jaw 18 which is necessary to allow its sliding movement back and forth.

This brings us to the use of the second or tightening actuator or lever 34 in order to provide a tighter grip on the work piece 306. It is noted that all of the previously discussed steps of the process or operation of wrench 1 are undertaken prior to the use of lever 34, which remains in its home resting position illustrated in all of the figures through FIG. 7. While gripping surfaces 120 and 122 are adjacent the nut or other work piece 306 and locking member 22 lockingly engages jaw 18 as a result of releasing lever 28 (Arrow J), the user now activates the tightening mechanism by squeezing handle 14 and lever 34 together such that a manual force F2 (FIG. 8) is applied to the bottom pushing surface of bottom wall 240 of lever 34, which overcomes the force of spring 36 and causes the rear end of lever 34 to rotate (Arrow L in FIG. 8) about the forward pivot 264 to tighten the jaws. More particularly, the pivotal movement of lever 34 causes the upward pivotal movement of locking member pivot 186 from the position shown in FIG. 1 to the position shown in FIG. 8 within the elongated slot 95, which is shown in dashed lines in FIGS. 1 and 8 and in solid lines in FIG. 3. The movement of pivot 186 also causes the upward movement of locking member 22 and jaw 18 via the locking engagement therebetween, such that the upward movement of pivot 186, locking member 22, and jaw 18 are all represented at Arrow M in FIG. 8, and is perpendicular to the horizontal axis about which locking member 22 pivots. During the tightening movement, locking member 22 and its teeth are fixed relative to jaw and its teeth. This process of tightening the jaws around the work piece 306 ensures a secure grip on the work piece so that the user of wrench 1 is ready to rotate the handle 14 about the center of work piece 306 to rotate work piece 306 while maintaining this secure grip.

In addition to the tightening mechanism which is actuated by the pressure on the rear section of lever 34, wrench 1 is configured to secure lever 34 in the tightened position using lever locking member 38. With continued reference to FIG. 8, the pivotal movement of lever 34 illustrated at Arrow L causes the rear end of catch 266 during its upward movement to slidably engage the front of leg 280 of locking member 38 to cause member 38 to rotate (Arrow N) about pivot 288 from the position shown in solid lines to the position shown in dashed lines until catch leg 272 moves above locking ledge 290 of leg 280, at which time spring 40 extends to bias locking member 38 by pivotal movement (Arrow O) back to its position shown in solid lines so that locking ledge 290 engages catch ledge 272 to secure or lock lever 34 in the tightened or closed position shown in FIG. 8. More particularly, the engagement between ledges 272 and 290 prevents the pivotal movement in the loosening direction (opposite Arrow L) which would otherwise be caused by the spring bias of spring 36. As previously discussed, spring 40 biases locking member 38 to its locking position, and thus keeps locking member 38 in the locking position absent a force to pivot locking member 38 in the direction of Arrow N to overcome the spring bias of spring 40. The locking feature of locking member 38 thus allows the user to maneuver his or her hands as desired while the gripping surfaces of the jaws are tightly secured to the work piece 306.

To release lever 34 from the locked tightening position and thus allow it to move to its open home resting position under the force of the spring 36, the user merely applies a force F3 (FIG. 8A) to the bottom surface of release member 42 rearwardly of pivot 294. More particularly, applying force F3 in a squeezing manner relative to handle 14 causes the rear end of member 42 to move pivotally (Arrow P) about pivot 294 and consequently causes cam surface 296 to pivot forward while slidably engaging cam surface 286 in order to pivot locking member 38 (Arrow Q) from its locked position to the unlocked position shown in FIG. 8A whereby ledges 272 and 290 are disengaged from one another. Thus, once the user presses release member 42 as noted, lever 34 will automatically return from the tightened position to the loosened or home position (Arrow R) under the force of spring 36 absent a force such as force F2 to the contrary. Movement of lever 34 in the loosening direction (Arrow R) thus causes jaw 18 to move away from jaw 16 (Arrow S) to loosen the grip on work piece 306. More particularly, movement of lever 34 in the direction of Arrow R likewise reverses the tightening process such that pivot 186 moves downwardly within slot 95, consequently moving locking member 22 and jaw 18 downwardly.

Figure 8A:
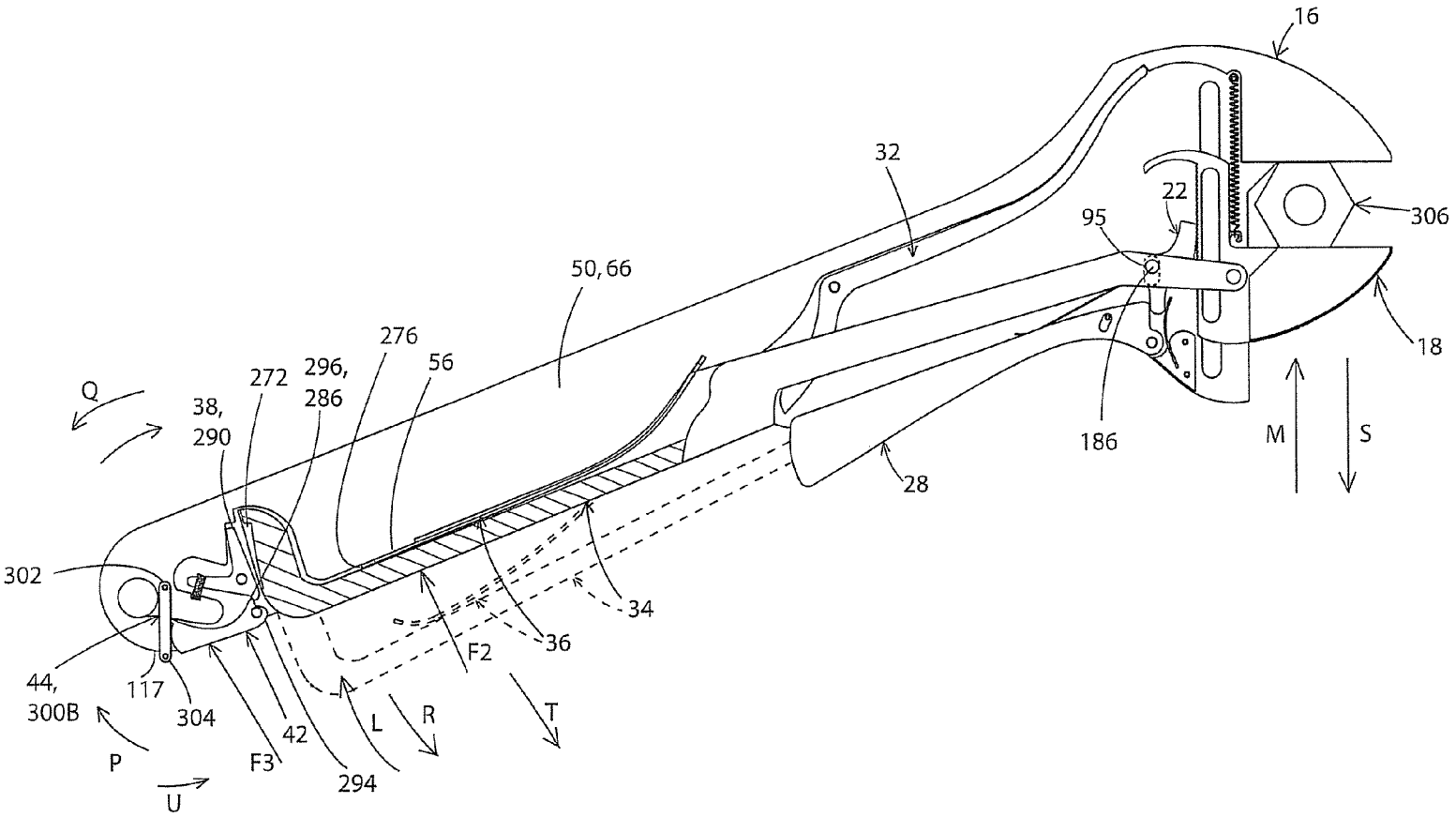
FIG. 8A is similar to FIG. 8 and illustrates the use of the release member, the retaining member, and the movement of the tightening lever to tighten and loosen the jaws.

In addition to release member 42, retaining member 44 also provides a retaining mechanism for retaining or securing release member 42 in its depressed or upwardly pivoted releasing position so that release member 42 consequently retains or keeps locking member 38 in its unlocked position so that the user may apply force F2 to move lever 34 from the loosened position to the tightening position and also release the force (Arrow T) to allow lever to move from the tightened position to the loosened home position without being locked in the tightened position by the engagement of ledges 272 and 290. More particularly, while release member 42 is pressed upwardly to its releasing position, the user may apply a forward force to member 44 below pivot 302 in order to pivot retaining bar 304 from its position rearward of leg 117 to a position below release member 42 so that retaining bar 304 abuts the bottom surface of member 42 in order to retain member 42 in the releasing position. Thus, member 44 is pivotally moved (Arrow U) from a non-retaining position (FIG. 8) to a retaining position (FIG. 8A). While retaining member 44 remains in the retaining position, release member 42 thus remains in the released position and locking member 38 remains in the unlocked position in order to allow the pivotal movement in either direction (Arrows L and R) of lever 34 between the tightened and untightened positions without becoming locked in the tightened position.

Adjustable wrench 1A is now described with reference to FIGS. 9-12. Wrench 1A is similar to wrench 1 with the primary exception being that, unlike the lever 28 of wrench 1 which is manually engaged to apply a pivoting force in one direction while spring 30 applies a pivoting force in the opposite direction, wrench 1A includes an analogous lever 28A which is moved pivotally by a slider member mounted on the wrench handle. In keeping with this alternate configuration, wrench 1A also includes a handle 14A which is somewhat different than handle 14 and a tightening lever 34A which is similar but somewhat different from lever 34. In addition, wrench 1A eliminates the use of spring 30 or a like spring for biasing lever 28A to the open position, in which locking member 22 is in its locked position. Thus, the corresponding pins 216 and holes 94 are eliminated. In addition, wrench 1A eliminates holes 92, pin 200 and slot 198. As noted above, lever 34A is somewhat different than lever 34 in that it includes a bottom wall 240A which extends from the rear of the lever forward a further distance than that of bottom wall 240 such that wall 240A is connected to arms 252A which are analogous to arms 252 of wrench 1. In addition, arms 252A are dropped or lowered compared to arms 252 so that they extend forward from the lower front part of the rear section of handle 34A. However, lever 34A functions in the same manner as described with respect to handle 34.

Handle 14A includes central wall 50 and left and right walls 52A and 54A which are similar but somewhat different from walls 52 and 54 of wrench 1. As previously noted, some of the holes formed in walls 52 and 54 are eliminated in walls 52A and 54A. In addition, an elongated slot or keyway 310 is formed in each of walls 52A and 54A so that they are aligned with one another as viewed from the side. Keyway 310 is straight and elongated between a front end 312 and a rear end 314 and defined therebetween by top and bottom straight edges 316 and 318. Edges 316 and 318 and thus keyway 310 are substantially parallel to the length of handle 14A and generally parallel to levers 28A and 34A. A slider 320 is slidably disposed within each keyway 310 and is elongated between a front end 322 and a rear end 324 thereof. Each slider 320 has an upwardly facing top straight edge 326 which slidably engages the downwardly facing top straight edge 316, and a downwardly facing bottom straight edge 328 which slidably engages the upwardly facing bottom straight edge 318 during sliding movement of slider 320 forward or rearward within keyway 310. The left slider 320 has a left outer surface and the right slider 320 has a right outer surface, each of which defines a finger tab 330 which in the exemplary embodiment has ridges formed thereon to provide a gripping surface for a finger or thumb. A cam 332 in the form of a rod is secured to and extends between sliders 320. Sliders 320 and cam 332 serve as a rigid slider member which is slidable back and forth.

Figure 10:
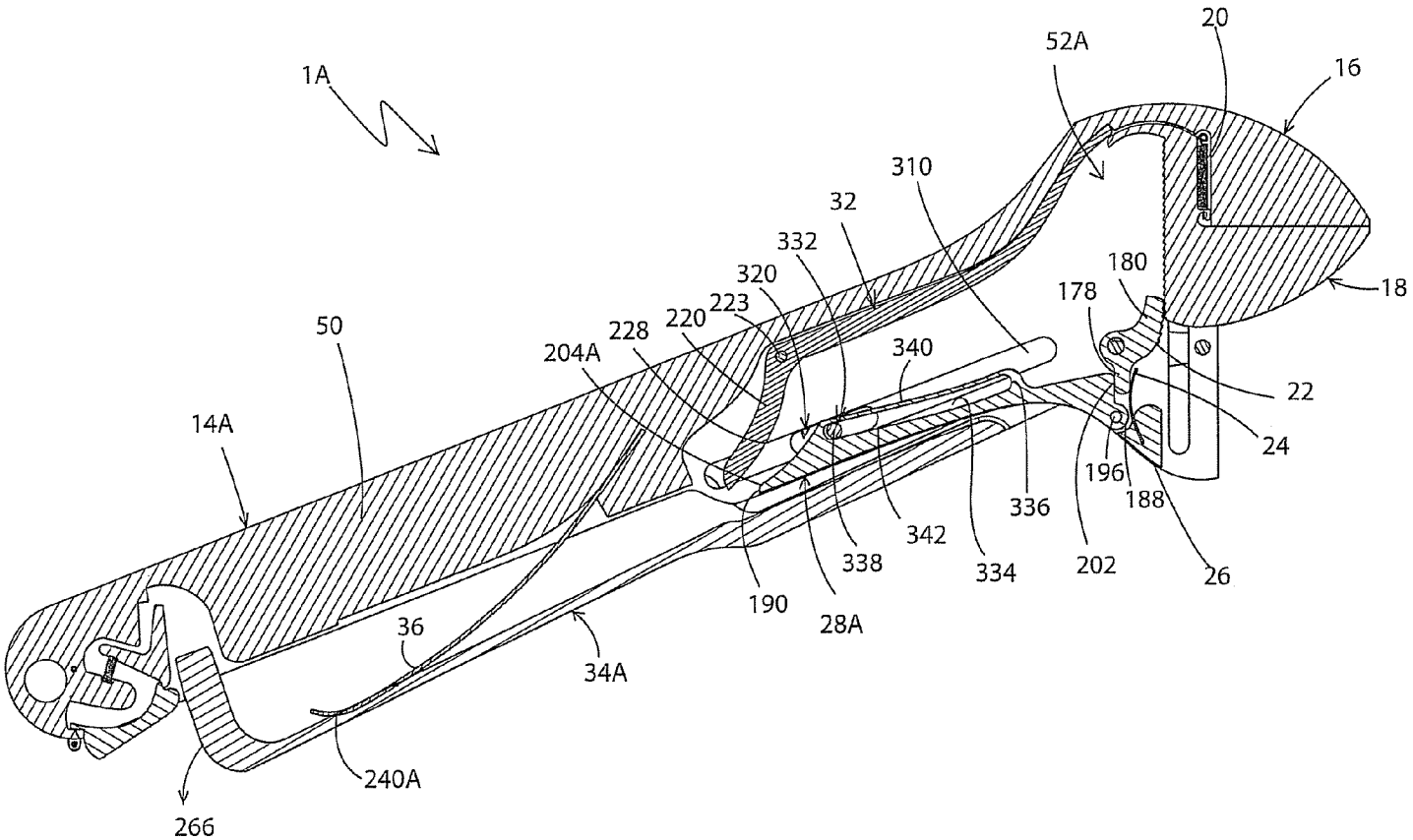
FIG. 10 is a sectional view of the second embodiment similar to FIG. 4 with the jaws in the fully closed position.

Referring now to FIG. 10, lever 28A is similar to lever 28 whereby lever 28A has front and rear ends 188 and 190 between which it is elongated. As previously noted, lever 28A is formed without slot 198, but retains pivots 196 and front cam 202. Unlike lever 28, which vertically widens toward rear end 190, lever 28A adjacent rear end 190 tapers rearwardly to form a V-shaped configuration as viewed from the side whereby it narrows toward rear end 190. Lever 28A includes a rear cam 204A which is analogous to cam 204 and which is positioned adjacent the tip of the V-shaped end 190. Lever 28A further defines an elongated slot or keyway 334 having front and rear ends 336 and 338 between which it is elongated from front to back. Slot 334 is also divided by top and bottom substantially straight edges 340 and 342 which serve as cam surfaces and more particularly as cam followers which follow cam 332 during sliding movement thereof. Top cam surface 340 faces downwardly while bottom cam surface 342 faces upwardly.

Figure 11:
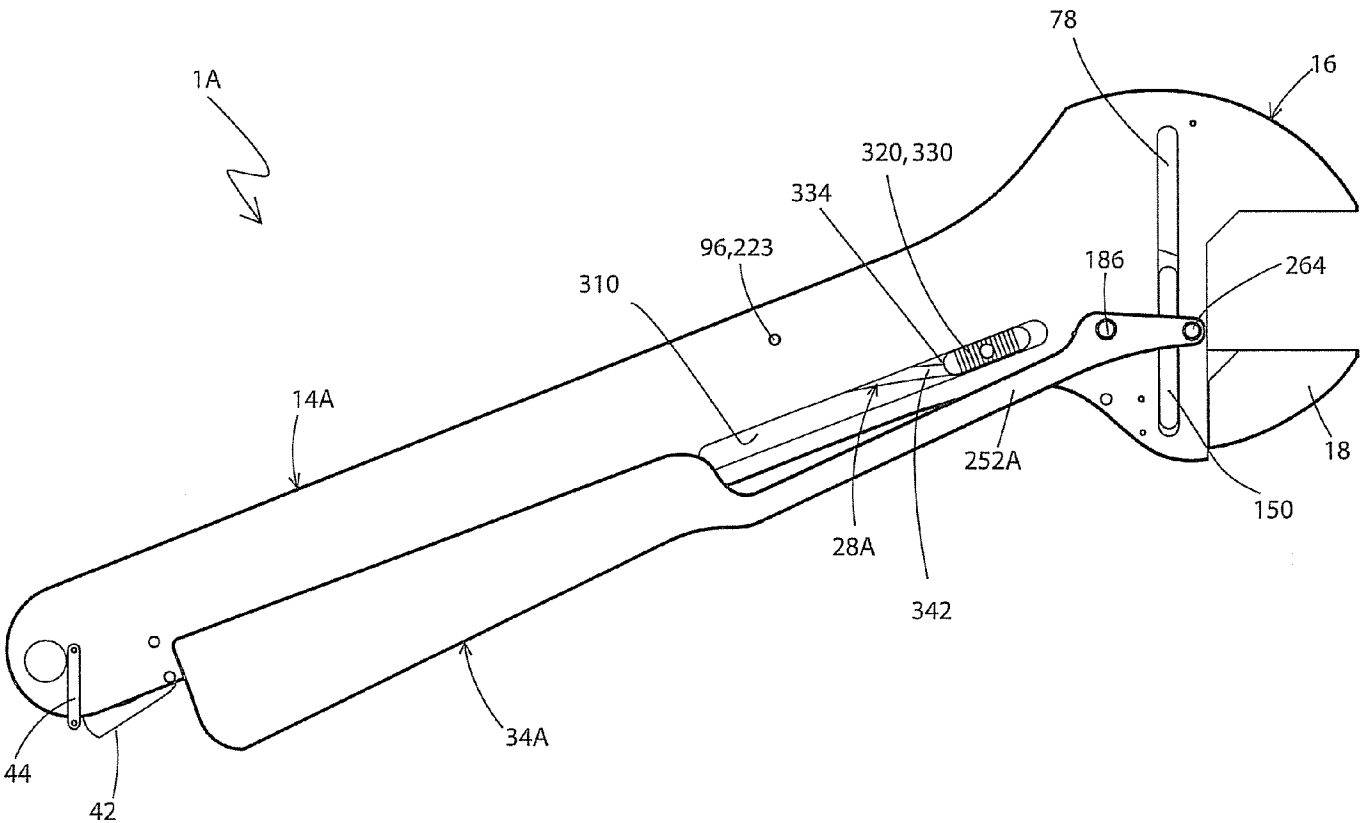
FIG. 11 is a right side elevational view similar to FIG. 9 showing the manual slider having moved from the position of FIG. 9 to open the jaws.
Figure 12:
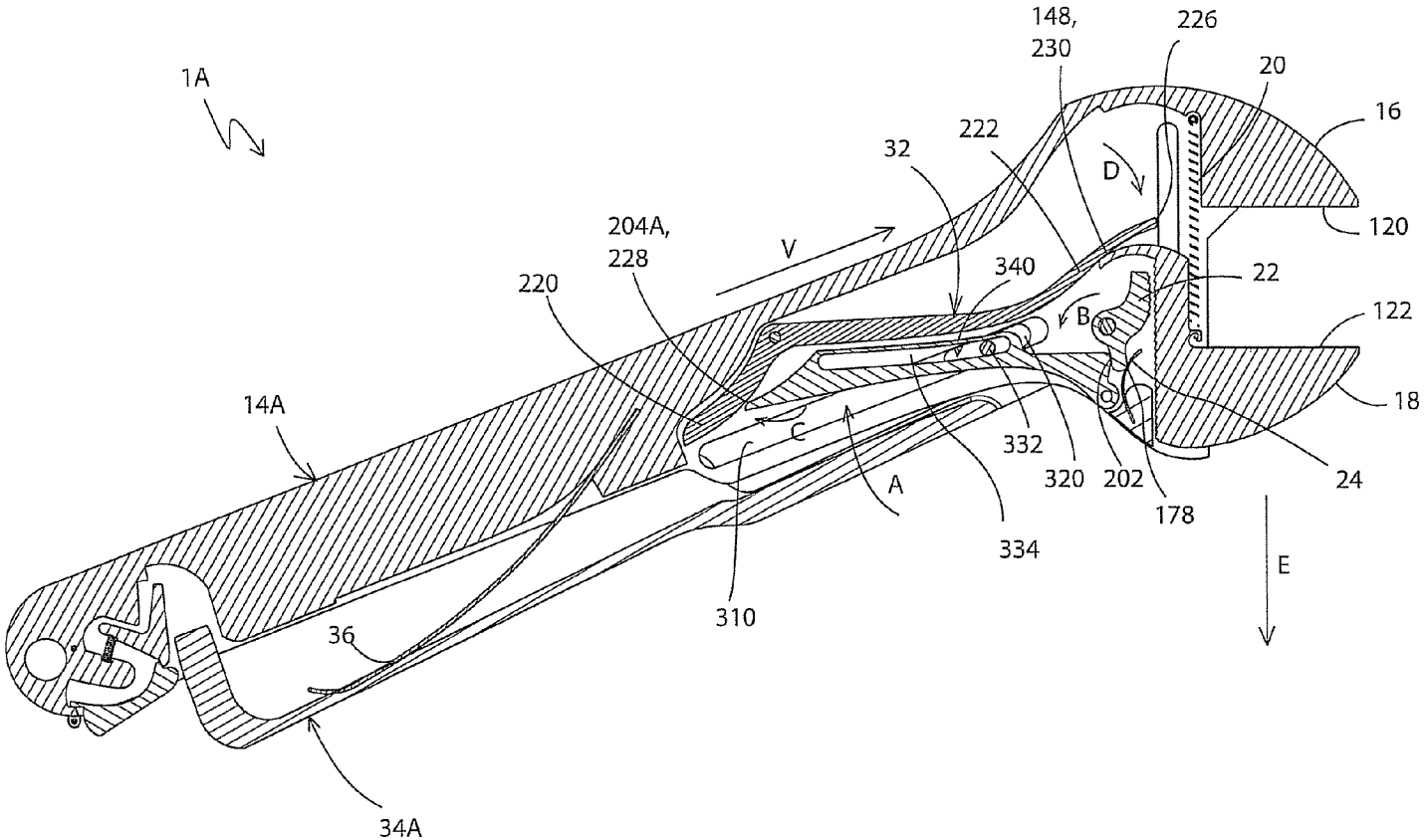
FIG. 12 is a sectional view similar to FIG. 10 with the jaws in the open position of FIG. 11.

The operation of wrench 1A is now described with reference to FIGS. 9-12. FIGS. 9 and 10 show the sliders 320 in a rearward position which is associated with the jaws 16 and 18 being in a fully closed position. FIGS. 11 and 12 show the slider member in a forward position with jaws 16 and 18 in an open position which is analogous to that of the jaws in FIG. 5 of wrench 1. As shown in FIG. 10, cam 332 passes through keyway 334 and is adjacent or abutting rear end 338 thereof. Thus, the rear portion of keyway 334 is aligned with keyways 310 as viewed from the side in the position of FIGS. 9 and 10, in which rear end 190 of lever 28A is in its lowermost position. To open jaws 16 and 18, the user manually engages finger tabs 330, applying a forward force thereon to slide the slider member forward with sliders 320 sliding within respective keyways 310 and cam 332 sliding within keyway 334. During this forward sliding movement (Arrow V in FIG. 12) of the sliding member, the upwardly facing portion of cam 332 slidably engages cam follower surface 340 whereby the sliding engagement therebetween applies an upward force on top cam surface 340 to cause the rear end 190 of lever 28A to pivot upwardly as indicated at Arrow A in FIG. 12. This pivotal movement of lever 28A opens jaw 18 in the same manner as previously discussed with respect to lever 28 of wrench 1. Thus, cam 202 engages cam follower 178 to rotate locking member 22 against the spring force of spring 24 to disengage the locking member from jaw 18 (Arrow B). In addition, cam 204A slidably engages cam follower 228 to pivot member 32 with shorter leg 220 pivoting as shown at Arrow C and longer leg 222 pivoting as shown at Arrow D whereby the sliding engagement between cam surfaces 148 and 230 forces jaw 18 downwardly as shown at Arrow E. The slider member may be slid rearwardly from the position of FIGS. 11 and 12 to the position of FIGS. 9 and 10 by manual force applied to finger tabs 330 to reverse the pivotal movement of lever 28A, link 32 and locking member 22 as well as the sliding movement of jaw 18. During rearward movement of the slider member, slider 320 slidably engage lower cam surfaces 342 to translate the rearward movement to the downward pivotal movement of rear end 190 of lever 28A.

In addition, the force applied by extended spring 20 to jaw 18 may be sufficient to pull jaw 18 toward jaw 16 to drive the reverse pivoting movement of link 32 to consequently drive the reverse pivotal movement of lever 28A via the sliding engagement between cam surfaces 204A and 228 to likewise cause the slider member to slide rearwardly via the sliding cam engagement between cam 332 and cam surface 340. In this case, cam surface 148 would serve as a driving cam with surface 230 serving as a cam follower. Likewise, cam surface 228 would serve as a driving cam with surface 204A serving as a cam follower and surface 340 would serve as a driving cam with cam member 332 serving as a cam follower. However, the force of spring 20 may not be sufficient to achieve this reverse sliding of the slider, especially depending on the angle between the parallel straight surfaces 316 and 318 and the parallel straight surfaces 340 and 342. Where this angle is sufficiently small, the slider member would tend to remain in the forward position after the user has released a grip on finger tabs 330 and thus removing an external force applied to the sliders.

In any case, wrench 1A may be placed with its open jaws (FIGS. 11 and 12) about a work piece such as work piece 306 (FIGS. 8 and 8A) in order to move jaw 18 toward jaw 16 and engage work piece 306 as previously described in general. However, if the spring bias is not sufficient to move the sliding member rearwardly, the user must apply rearward force to the sliding member via finger tabs 330 in order to allow jaw 18 to close under the bias of spring 20. Once jaws 16 and 18 of wrench 1A have reached the position shown in FIG. 8, the jaws may be tightened on the nut using lever 34A in the same manner as described with regard to lever 34. Thus, the use of lever 34A, locking member 38, release member 42 and retaining member 44 are the same with respect to wrench 1A as with wrench 1.

Thus, the adjustable wrenches of the present invention provide for the ability to rapidly spread the jaws of the wrench, rapidly clamp the jaws onto a work piece utilizing the spring bias of spring 20 and also to easily tighten the jaws about such a work piece.

In the foregoing description, certain terms have been used for brevity, clearness, and understanding. No unnecessary limitations are to be implied therefrom beyond the requirement of the prior art because such terms are used for descriptive purposes and are intended to be broadly construed.

Moreover, the description and illustration of the invention is an example and the invention is not limited to the exact details shown or described.

The invention claimed is:

1. An adjustable wrench comprising:

an elongated handle having front and rear ends;

first and second jaws mounted on the handle adjacent the front end; wherein the first jaw is movable toward and away from the second jaw;

a spring which biases the first jaw toward the second jaw;

a jaw locking member which is movable between a locked position and an unlocked position; wherein the locking member in the locked position secures the first jaw in a selected one of a plurality of secured positions to prevent movement of the first jaw toward the second jaw in response to the bias of the spring; and the locking member in the unlocked position allows the movement of the first jaw toward the second jaw in response to the bias of the spring;

a jaw-opening actuator having first and second actuator positions; wherein in response to movement of the actuator from the first actuator position to the second actuator position, the locking member moves from the locked position to the unlocked position and the first jaw moves away from the second jaw;

a tightening lever pivot;

a tightening lever which is pivotally mounted on the handle about the tightening lever pivot and has a rear end rearward of the tightening lever pivot; and a locking member pivot having an axis about which the locking member is pivotally mounted;

wherein when the locking member is in the locked position and a squeezing force is applied to the tightening lever and handle to move the rear end of the tightening lever toward the handle, the locking member moves perpendicular to the locking member axis to cause the first jaw to move toward the second jaw.

2. The wrench of claim 1 further comprising a drive arm which is pivotally mounted on the handle;

a first engagement between the drive arm and first jaw;

wherein the drive arm pivots in response to movement of the actuator from the first actuator position to the second actuator position.

3. The wrench of claim 2 further comprising a second engagement between the actuator and drive arm.

4. The wrench of claim 3 wherein the drive arm has front and rear ends;

the actuator is pivotally mounted on the handle and has front and rear ends;

the first engagement is adjacent the front end of the drive arm; and the second engagement is adjacent the rear end of the actuator and rear end of the drive arm.

5. The wrench of claim 3 further comprising a third engagement between the actuator and locking member.

6. The wrench of claim 3 further comprising a drive arm pivot about which the drive arm is pivotally mounted on the handle;

a first leg of the drive arm which extends radially outwardly from adjacent the drive arm pivot in a first direction;

a second leg of the drive arm which extends radially outwardly from adjacent the drive arm pivot in a second direction different from the first direction;

wherein the first engagement is between the first leg and first jaw;

the second engagement is between the actuator and second leg.

7. The wrench of claim 6 wherein the first leg extends forward from adjacent the drive arm pivot; and the second leg extends rearward from adjacent the drive arm pivot.

8. The wrench of claim 6 further comprising a first distance from the drive arm pivot to the second engagement; and a second distance from the drive arm pivot to the first engagement; wherein the second distance is at least twice the first distance.

9. The wrench of claim 1 further comprising a drive train which drives movement of the first jaw away from the second jaw and comprises the actuator;

a drive arm pivot;

a drive arm of the drive train which is pivotally mounted about the drive arm pivot;

an engagement between the actuator and drive arm rearward of the drive arm pivot;

wherein the drive arm pivots in response to movement of the actuator from the first position to the second position.

10. The wrench of claim 1 further comprising a slider member slidably mounted on the handle; and a sliding engagement between the slider member and actuator during sliding movement of the slider member which causes the actuator to move from the first actuator position to the second actuator position.

11. The wrench of claim 1 further comprising a first rack of locking teeth on the first jaw;

a second rack of locking teeth on the first jaw;

a first spacing between adjacent teeth of the first rack;

a second spacing between adjacent teeth of the second rack which is different than the first spacing;

a first tooth on the locking member engageable with the locking teeth of the first rack; and a second tooth on the locking member engageable with the locking teeth of the second rack.

12. The wrench of claim 1 further comprising an actuator pivot adjacent the front end of the handle;

wherein the jaw opening actuator is pivotally mounted about the actuator pivot and extends rearwardly therefrom;

a drive arm pivot which is rearward of the actuator pivot;

a drive arm comprising a rear leg extending rearwardly from adjacent the drive arm pivot and a front leg extending forward from adjacent the drive arm pivot;

a first engagement between the actuator and the rear leg of the drive arm during pivotal movement of the actuator; and a second engagement between the front leg of the drive arm and the first jaw during pivotal movement of the drive arm;

wherein the first jaw moves away from the second jaw in response to pivotal movement of the actuator.

13. An adjustable wrench comprising:

an elongated handle having front and rear ends;

first and second jaws mounted on the handle adjacent the front end; wherein the first jaw is movable toward and away from the second jaw;

a spring which biases the first jaw toward the second jaw;

a jaw locking member which is movable between a locked position and an unlocked position; wherein the locking member in the locked position secures the first jaw in a selected one of a plurality of secured positions to prevent movement of the first jaw toward the second jaw in response to the bias of the spring; and the locking member in the unlocked position allows the movement of the first jaw toward the second jaw in response to the bias of the spring;

a jaw-opening actuator having first and second actuator positions; wherein in response to movement of the actuator from the first actuator position to the second actuator position, the locking member moves from the locked position to the unlocked position and the first jaw moves away from the second jaw;

a drive train which drives movement of the first jaw away from the second jaw and comprises the actuator;

first and second opposed ends of the actuator;

a drive arm of the drive train;

an actuator pivot which is adjacent the first end of the actuator and about which the actuator is pivotally mounted;

a drive arm pivot which is adjacent the second end of the actuator and about which the drive arm is pivotally mounted.

14. The wrench of claim 13 wherein the actuator pivot is adjacent the first jaw; and the drive arm pivot is rearward of and distal the first jaw.

15. The wrench of claim 14 wherein the first and second ends of the actuator are respectively front and rear ends;

the actuator pivot is adjacent the front end of the actuator; and the drive arm pivot is adjacent the rear end of the actuator.

16. The wrench of claim 13 further comprising a tightening lever pivot;

a tightening lever which is pivotally mounted on the handle about the tightening lever pivot and has a rear end rearward of the tightening lever pivot;

a locking member pivot having an axis about which the locking member is pivotally mounted;

wherein when the locking member is in the locked position and a squeezing force is applied to the tightening lever and handle to move the rear end of the tightening lever toward the handle, the locking member moves perpendicular to the locking member axis to cause the first jaw to move toward the second jaw.

17. An adjustable wrench comprising:

an elongated handle having front and rear ends;

first and second jaws mounted on the handle adjacent the front end; wherein the first jaw is movable toward and away from the second jaw;

a spring which biases the first jaw toward the second jaw;

a jaw locking member which is movable between a locked position and an unlocked position; wherein the locking member in the locked position secures the first jaw in a selected one of a plurality of secured positions to prevent movement of the first jaw toward the second jaw in response to the bias of the spring; and the locking member in the unlocked position allows the movement of the first jaw toward the second jaw in response to the bias of the spring;

a jaw-opening actuator having first and second actuator positions; wherein in response to movement of the actuator from the first actuator position to the second actuator position, the locking member moves from the locked position to the unlocked position and the first jaw moves away from the second jaw;

a first lever pivot adjacent the front end of the handle;

a second lever pivot adjacent the front end of the handle;

wherein the jaw-opening actuator is a first lever pivotally mounted on the handle about the first lever pivot;

a rear end of the first lever;

a second lever pivotally mounted on the handle about the second lever pivot;

a front segment of the second lever comprising left and right side walls defining therebetween a space in which the first lever is disposed; and a rear segment of the second lever comprising an axially extending wall which extends from the left sidewall to the right sidewall and has a front end rearward of the rear end of the first lever.

18. The wrench of claim 17 further comprising a tightening mechanism capable of moving the first jaw toward the second jaw when the locking member is in the locked position.

19. The wrench of claim 18 further comprising an actuator locking member which releasably locks the tightening mechanism in the tightened position.

* * * * *